US012515101B2

(12) United States Patent
Kim et al.

(10) Patent No.: US 12,515,101 B2
(45) Date of Patent: Jan. 6, 2026

(54) ELECTRONIC DEVICE AND WEARABLE DEVICE FOR PROVIDING FUNCTION FOR MEASURING AMOUNT OF EXERCISE AND OPERATION METHODS THEREOF

(71) Applicant: Samsung Electronics Co., Ltd., Suwon-si (KR)

(72) Inventors: Sugyeong Kim, Suwon-si (KR); Harkjoon Kim, Suwon-si (KR); Heeyoung Cho, Suwon-si (KR); Soojung Bae, Suwon-si (KR); Chiyoung Ahn, Suwon-si (KR); Sangyoon Lee, Suwon-si (KR); Sunae Kim, Suwon-si (KR); Jisu Kim, Suwon-si (KR); Philgu Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 197 days.

(21) Appl. No.: 18/454,325

(22) Filed: Aug. 23, 2023

(65) Prior Publication Data

US 2023/0398407 A1 Dec. 14, 2023

Related U.S. Application Data

(63) Continuation of application No. PCT/KR2023/004383, filed on Mar. 31, 2023.

(30) Foreign Application Priority Data

Jun. 10, 2022 (KR) ..... 10-2022-0070952
Sep. 30, 2022 (KR) ..... 10-2022-0125733

(51) Int. Cl.
*A63B 24/00* (2006.01)
*A63B 71/06* (2006.01)

(52) U.S. Cl.
CPC ..... *A63B 24/0062* (2013.01); *A63B 24/0006* (2013.01); *A63B 24/0087* (2013.01);
(Continued)

(58) Field of Classification Search
CPC ..... A63B 24/0062; A63B 24/0006; A63B 24/0087; A63B 71/0622;
(Continued)

(56) References Cited

U.S. PATENT DOCUMENTS 7,662,065 B1 * 2/2010 Kahn ..... G16H 20/30 482/8
7,771,320 B2 * 8/2010 Riley ..... G16Z 99/00 434/238
(Continued)

FOREIGN PATENT DOCUMENTS

CN 105992554 A 10/2016
KR 101085053 B1 11/2011
(Continued)

OTHER PUBLICATIONS

International Search Report for PCT/KR2023/004383 mailed Jul. 5, 2023, 4 pages.
(Continued)

*Primary Examiner* — Sundhara M Ganesan
(74) *Attorney, Agent, or Firm* — NIXON & VANDERHYE P.C.

(57) ABSTRACT

An electronic device and/or a wearable device providing exercise amount measurement information, and/or operation methods thereof. An electronic device may include: a communication module configured to receive, from a wearable device, sensor data including movement information during an exercise of a user wearing the wearable device; an input module configured to receive a user input that selects an exercise intensity to be applied to the exercise of the user; a
(Continued)

processor configured to estimate an exercise amount of the user based on the received sensor data and the selected exercise intensity, and generate an exercise activity indicator including at least one graphic indicator indicating the estimated exercise amount; and a display module configured to output a graphical user interface (GUI) on which the exercise activity indicator is displayed.

19 Claims, 19 Drawing Sheets

(52) U.S. Cl.
CPC .. *A63B 71/0622* (2013.01); *A63B 2024/0065* (2013.01); *A63B 2220/836* (2013.01)

(58) Field of Classification Search
CPC ..... A63B 2024/0065; A63B 2220/836; A63B 24/00; A63B 71/06; G06F 1/16; G06F 3/04817; G06F 3/0482; G06F 3/04842; G16H 40/63; G16H 50/20; G16H 50/30; G16H 20/30; A61B 5/1118
See application file for complete search history.

(56) References Cited

U.S. PATENT DOCUMENTS

| | | | | |
|---|---|---|---|---|
| 7,840,346 | B2 * | 11/2010 | Huhtala | A63B 24/0062 702/182 |
| 8,235,724 | B2 | 8/2012 | Gilley et al. | |
| 9,392,941 | B2 * | 7/2016 | Powch | G01S 19/19 |
| 10,088,901 | B2 * | 10/2018 | Kang | G06F 3/014 |
| 10,238,915 | B2 * | 3/2019 | Pulkkinen | G16H 20/30 |
| 10,478,708 | B2 * | 11/2019 | Bleich | A63B 24/0075 |
| 11,081,223 | B2 * | 8/2021 | Tagliabue | G16H 20/30 |
| 11,224,782 | B2 | 1/2022 | Blahnik et al. | |
| 11,253,749 | B2 * | 2/2022 | Lynch | G06F 16/26 |
| 11,735,308 | B2 * | 8/2023 | Weast | A61B 5/1118 482/8 |
| 11,985,506 | B2 * | 5/2024 | Devine | G06F 3/04842 |
| 2002/0042328 | A1 * | 4/2002 | Yoo | A63B 22/00 482/8 |
| 2006/0004265 | A1 * | 1/2006 | Pulkkinen | A61B 5/0205 600/300 |
| 2009/0069156 | A1 * | 3/2009 | Kurunmaki | G16H 20/30 482/148 |
| 2012/0015778 | A1 * | 1/2012 | Lee | G16H 40/63 482/8 |
| 2014/0040266 | A1 | 2/2014 | Johnson | |
| 2014/0073486 | A1 * | 3/2014 | Ahmed | A61B 5/11 600/479 |
| 2014/0141937 | A1 * | 5/2014 | Kim | A61B 5/02438 600/483 |
| 2015/0250417 | A1 * | 9/2015 | Cheng | A61B 5/4866 600/509 |
| 2016/0144236 | A1 * | 5/2016 | Ko | G16H 20/30 434/247 |
| 2017/0165525 | A1 * | 6/2017 | Tellez | A63B 71/0622 |
| 2017/0354845 | A1 * | 12/2017 | Williams | G06T 11/60 |
| 2018/0240358 | A1 * | 8/2018 | Crepp | A63B 24/0075 |
| 2019/0150792 | A1 * | 5/2019 | Nakashima | A61B 5/1128 |
| 2019/0232110 | A1 * | 8/2019 | Williams | G06F 3/04883 |
| 2020/0261011 | A1 * | 8/2020 | Seppänen | A61B 5/0255 |
| 2021/0128972 | A1 | 5/2021 | Lee et al. | |
| 2021/0275863 | A1 | 9/2021 | Logan | |
| 2021/0394022 | A1 * | 12/2021 | Toiviainen | G06Q 10/06 |
| 2022/0004167 | A1 * | 1/2022 | Zealand | G16H 20/30 |
| 2023/0211206 | A1 * | 7/2023 | Futrell | A63B 24/0075 |
| 2024/0206825 | A1 * | 6/2024 | Nozaki | A61B 5/02405 |

FOREIGN PATENT DOCUMENTS

| | | | |
|---|---|---|---|
| KR | 101379666 | B1 | 4/2014 |
| KR | 20170003608 | A | 1/2017 |
| KR | 20170013068 | A | 2/2017 |
| KR | 20170083829 | A | 7/2017 |
| KR | 102002290 | B1 | 7/2019 |
| KR | 20210128564 | A | 10/2021 |
| WO | 2017003045 | A1 | 1/2017 |

OTHER PUBLICATIONS

Partial Supplementary European Search Report dated Apr. 22, 2025 issued in European Patent Application No. 23819968.1, 19 pp.

* cited by examiner

ELECTRONIC DEVICE AND WEARABLE DEVICE FOR PROVIDING FUNCTION FOR MEASURING AMOUNT OF EXERCISE AND OPERATION METHODS THEREOF

CROSS-REFERENCE TO RELATED APPLICATIONS

This application is a continuation of International Application No. PCT/KR2023/004383 designating the United States, filed on Mar. 31, 2023, in the Korean Intellectual Property Receiving Office and claiming priority to Korean Patent Application No. 10-2022-0070952 filed on Jun. 10, 2022, and Korean Patent Application No. 10-2022-0125733 filed on Sep. 30, 2022, in the Korean Intellectual Property Office, the disclosures of which are incorporated by reference herein in their entireties.

BACKGROUND

1. Field

Certain example embodiments relate to an electronic device and/or a wearable device for providing an exercise amount measuring function, and/or operation methods of the electronic device and/or the wearable device.

2. Description of Related Art

A walking assistance device may generally be used to assist, with a walking exercise for rehabilitation for example, a user who has a hard time walking by themselves due to some reasons, for example, diseases or accidents, and/or for exercise purposes. Recent aging societies have contributed to a growing number of people who experience inconvenience and pain when walking from reduced muscular strength or joint problems due to aging, and there is thus a growing interest in walking assistance devices. A walking assistance device may be worn on a body of a user to provide the user with the power needed for the user to walk and/or assist the user with walking in a normal walking pattern.

SUMMARY

According to an example embodiment, an electronic device may include a communication module configured to receive, from a wearable device, sensor data including movement information during an exercise of a user wearing the wearable device. The electronic device may further include an input module configured to receive a user input that selects an exercise intensity to be applied to the exercise of the user. The electronic device may further include a processor configured to estimate an exercise amount of the user based on the received sensor data and the selected exercise intensity, and generate an exercise activity indicator including at least one graphic indicator indicating the estimated exercise amount. The electronic device may further include a display module configured to output a graphical user interface (GUI) in which the exercise activity indicator is displayed.

The at least one graphic indicator may include a first graphic element/indicator corresponding to a target exercise amount to be achieved by the user through the exercise. The at least one graphic indicator may further include a second graphic element/indicator corresponding to an exercise amount achievement estimate that is achieved by the user doing the exercise without the selected exercise intensity being applied. The at least one graphic indicator may further include a third graphic element/indicator corresponding to an additional exercise amount achievement estimate that is achieved by the user doing the exercise with the selected exercise intensity being applied.

According to an example embodiment, a wearable device for assisting a user in doing an exercise may include a driving module, comprising driving circuitry, configured to generate torque to be applied to a body of the user. The wearable device may further include a support frame configured to support the body of the user when the wearable device is worn on the body of the user and transmit the generated torque to the body of the user. The wearable device may further include a sensor module, comprising a sensor, configured to obtain sensor data including movement information of the user wearing the wearable device. The wearable device may further include a communication module, comprising communication circuitry, configured to receive setting data on an exercise intensity selected by a user input from an electronic device and transmit the sensor data to the electronic device. The wearable device may further include a control module, comprising control circuitry, configured to control the driving module based on the selected exercise intensity in the setting data. The control module may control the communication module to transmit the sensor data to the electronic device to allow the electronic device to estimate an exercise amount of the user based on the sensor data and the selected exercise intensity, generate an exercise activity indicator including at least one graphic indicator for indicating the estimated exercise amount, and output a GUI in which the exercise activity indicator is displayed.

According to an example embodiment, an operation method of an electronic device may include providing a personalized target exercise amount for a user. The operation method may further include receiving a user input that selects an exercise intensity to be applied to an exercise to be performed by the user. The operation method may further include transmitting, to a wearable device, setting data on the exercise intensity selected by the user input. The operation method may further include receiving, from the wearable device, sensor data including movement information obtained during the exercise of the user wearing the wearable device. The operation method may further include estimating an exercise amount of the user based on the received sensor data and the selected exercise intensity. The operation method may further include outputting a GUI in which an exercise activity indicator including at least one graphic indicator for indicating the estimated exercise amount is displayed.

According to an example embodiment, a non-transitory computer-readable storage medium storing instructions that, when executed by a processor, cause the processor to perform the operation method of the electronic device to described herein.

Other features and aspects will be apparent from the following detailed description, the drawings, and the claims.

BRIEF DESCRIPTION OF THE DRAWINGS

The above and other aspects, features, and advantages of certain embodiments of the present disclosure will be more apparent from the following detailed description, taken in conjunction with the accompanying drawings, in which.

DETAILED DESCRIPTION

Figure 1:
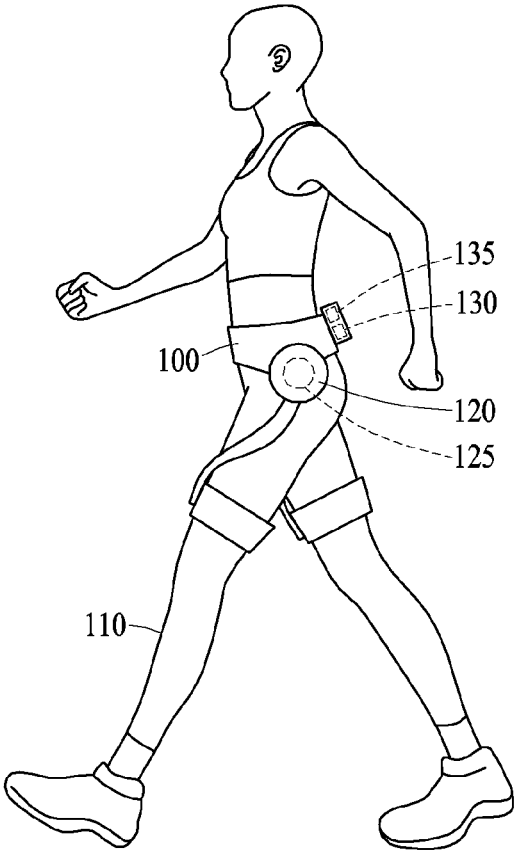
FIG. 1 is a diagram illustrating an overview of a wearable device worn on a body of a user according to an example embodiment.

The following detailed structural or functional description is provided merely as an example and various alterations and modifications may be made to the examples. Accordingly, actual implementations are not construed as limited to certain example embodiments of the disclosure and should be understood to include all changes, equivalents, and replacements within the idea and the technical scope of the disclosure.

As used herein, the singular forms "a," "an," and "the" include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or populations thereof.

Unless otherwise defined, all terms, including technical and scientific terms, used herein have the same meaning as commonly understood by those having ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Hereinafter, example embodiments will be described in detail with reference to the accompanying drawings. When describing the example embodiments with reference to the accompanying drawings, like reference numerals refer to like elements and a repeated description related thereto will be omitted.

FIG. 1 is a diagram illustrating an overview of a wearable device worn on a body of a user according to an example embodiment.

Referring to FIG. 1, a wearable device 100 may be a device that is worn on a body of a user 110 to assist the user 110 in walking (and/or gait), doing an exercise, and/or working more readily. In an example embodiment, the wearable device 100 may be used to measure a physical ability (e.g., a walking ability, and an exercise ability) of the user 110. The term "wearable device" used herein may be replaced with a "wearable robot," "walking assistance device," or "an exercise assistance device." The user 110 may be a human or an animal, but examples of which are not limited thereto. The wearable device 100 may be worn on the body (e.g., a lower body (e.g., legs, ankles, knees, etc.), an upper body (a torso, arms, wrists, etc.), or a waist) of the user 110 to apply an assistance force and/or a resistance force to a physical movement of the user 110. The assistance force, which is a force applied in the same direction as that of a physical movement of the user 110, may assist the user 110 in performing the physical movement. The resistance force, which is a force applied in a direction opposite to that of a physical movement of the user 110, may hinder the user 110 from performing the physical movement and may also be referred to as an "exercise load."

In an example embodiment, the wearable device 100 may operate in a walking assistance mode to assist the user 110 in walking. In the walking assistance mode, the wearable device 100 may assist the user 110 in walking by applying, to the body of the user 110, an assistance force generated from a driving module 120 of the wearable device 100. As the wearable device 100 assists the user 110 with a force required for the user 110 to walk, it may enable the user 110 to walk independently or walk for a longer period of time and may thereby increase a walking ability of the user 110. The wearable device 100 may also improve a gait of a user with an abnormal walking habit or walking posture.

In an example embodiment, the wearable device 100 may operate in an exercise assistance mode to enhance an exercise effect of the user 110. In the exercise assistance mode, the wearable device 100 may hinder the user 110 from performing a physical movement or apply resistance to a physical movement of the user 110 by applying, to the body of the user 110, a resistance force generated from the driving module 120. For example, when the wearable device 100 is a hip-type wearable device that is to be worn on the waist (or pelvis) and legs (e.g., thighs) of the user 110, the wearable device 100 may provide an exercise load to a leg movement of the user 110 while being worn on legs of the user 110 and may thereby enhance further an exercise effect on the legs of the user 110. In an example embodiment, the wearable device 100 may apply the assistance force to the body of the user 110 to assist the user 110 in doing an exercise. For example, when a physically challenged or elderly person attempts to do an exercise with the wearable device 100 worn on their body, the wearable device 100 may provide an assistance force for assisting a physical movement during their exercise. In an example embodiment, the wearable device 100 may provide the assistance force and the resistance force in a combined way according to each exercise interval or time interval, for example, by providing the assistance force in an exercise interval and the resistance force in another exercise interval.

In an example embodiment, the wearable device 100 may operate in a physical ability measurement mode to measure a physical ability of the user 110. While the user 110 is walking or doing an exercise, the wearable device 100 may measure movement information of the user 110 using sensors (e.g., an angle sensor 125 and an inertial measurement unit (IMU) 135) provided in the wearable device 100 and evaluate a physical ability of the user 110 based on the measured movement information. For example, based on the movement information of the user 110 measured by the wearable device 100, a gait index or an exercise ability index (e.g., muscular strength, endurance, and balance) of the user 110 may be estimated.

Although FIG. 1 illustrates an example of a hip-type wearable device for the convenience of description, a type of the wearable device 100 is not limited to the illustrated hip type. For example, the wearable device 100 may be provided in a type that is worn on other body parts (e.g., upper limbs, lower limbs, hands, calves, and feet) in addition to the waist and legs (thighs, in particular), and the shape and configuration of the wearable device 100 may vary according to a body part on which it is worn.

Figure 3:
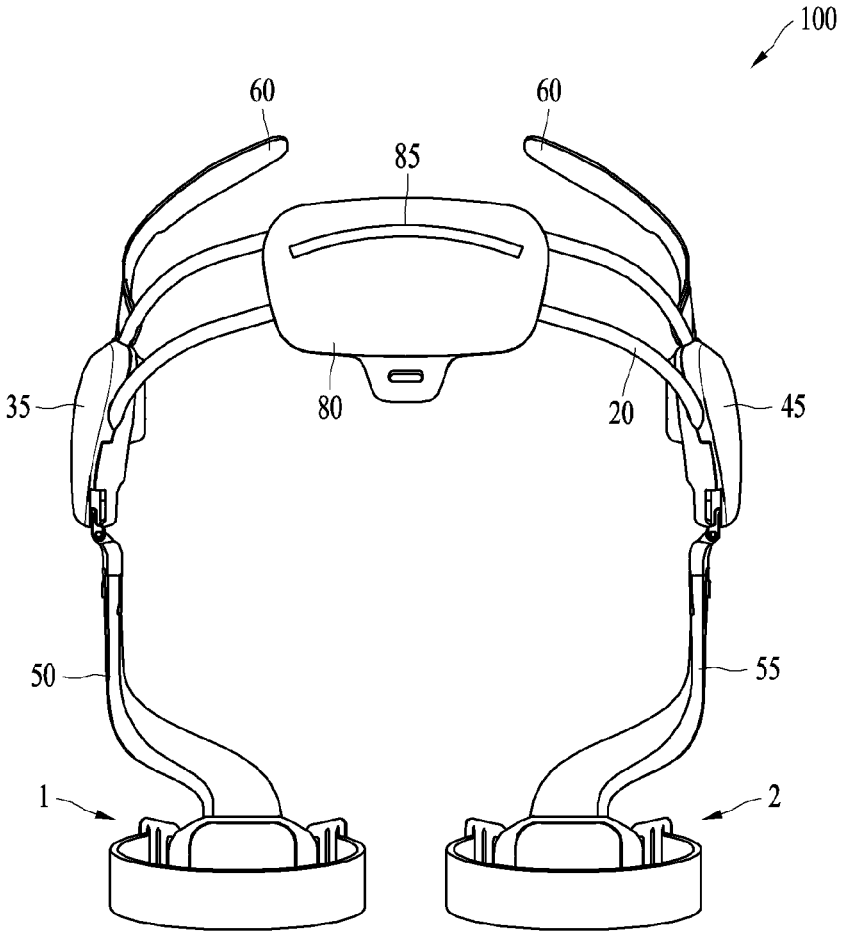
FIG. 3 is a rear view of an example of a wearable device according to an example embodiment.

According to an example embodiment, the wearable device 100 may include a support frame (e.g., leg support frames 50 and 55 and a waist support frame 20 of FIG. 3) configured to support the body of the user 110 when the wearable device 100 is worn on the body of the user 110, a sensor module (e.g., a sensor module 520 of FIG. 5A) configured to obtain sensor data including movement information about a body movement (e.g., a movement of the legs and a movement of the upper body) of the user 110, the driving module 120 (e.g., driving modules 35 and 45 of FIG. 3) configured to generate torque to be applied to the legs of the user 110, and a control module 130 (e.g., a control module 510 of FIGS. 5A and 5B) configured to control the wearable device 100.

The sensor module may include the angle sensor 125 and the IMU 135. The angle sensor 125 may measure a rotation angle of the leg support frame of the wearable device 100 corresponding to a hip joint angle value of the user 110. The rotation angle of the leg support frame measured by the angle sensor 125 may be estimated as the hip joint angle value (or a leg angle value) of the user 110. The angle sensor 125 may include, for example, an encoder and/or a Hall sensor. In an example embodiment, the angle sensor 125 may be present near a right hip joint and a left hip joint of the user 110, respectively. The IMU 135 may include an acceleration sensor and/or an angular velocity sensor and may measure a change in acceleration and/or angular velocity according to a movement of the user 110. For example, the IMU 135 may measure an upper body movement value of the user 110 corresponding to a movement value of the waist support frame (or a base body, e.g., a base body 80 of FIG. 3) of the wearable device 100. The movement value of the waist support frame measured by the IMU 135 may be estimated as the upper body movement value of the user 110.

In an example embodiment, the control module 130 and the IMU 135 may be arranged in the base body (e.g., the base body 80 of FIG. 3) of the wearable device 100. The base body may be positioned on a lumbar portion (e.g., a waist portion) of the user 110 while the wearable device 100 is worn on the user 110. The base body may be formed on or attached to the outside of the waist support frame of the wearable device 100. The base body may be provided on the lumbar portion of the user 110 to provide a cushioning feeling to the waist of the user 110 and may support the waist of the user 110 along with the waist support frame.

Figure 2:
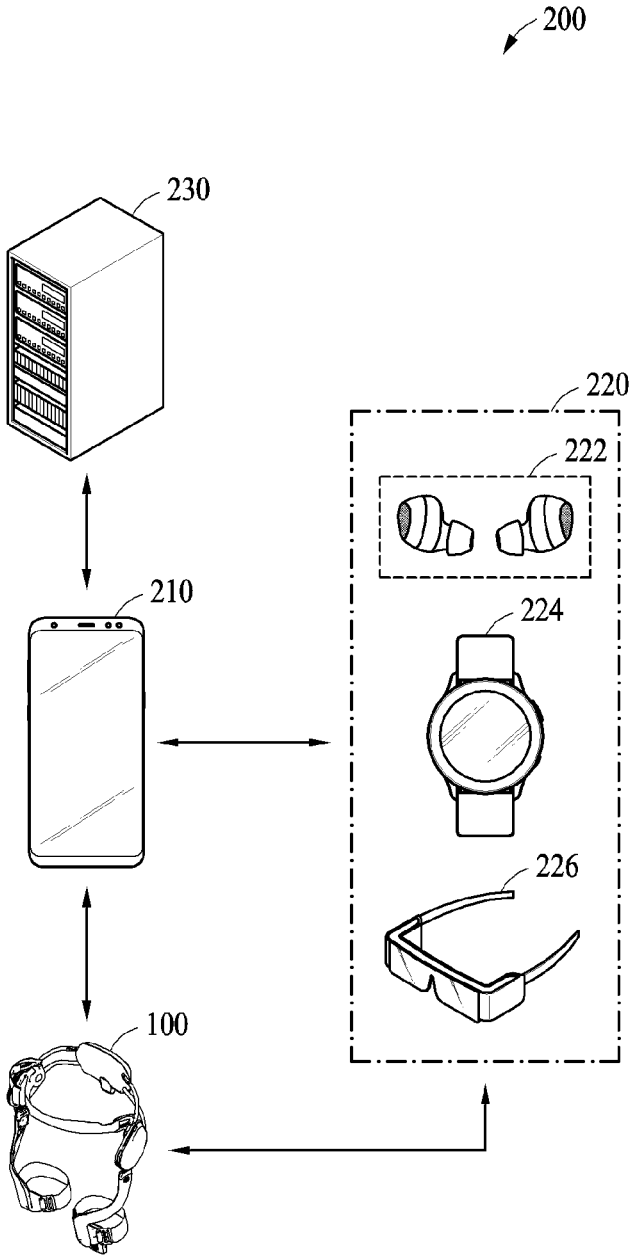
FIG. 2 is a diagram illustrating an example of an exercise management system including a wearable device and an electronic device according to an example embodiment.

FIG. 2 is a diagram illustrating an example of an exercise management system including a wearable device and an electronic device according to an example embodiment.

Referring to FIG. 2, an exercise management system 200 may include a wearable device 100 to be worn on a body of a user, an electronic device 210, another wearable device 220, and a server 230. In an example embodiment, at least one (e.g., the other wearable device 220 or the server 230) of these may be omitted from the exercise management system 200 or at least one another device (e.g., a dedicated controller device of the wearable device 100) may be added to the exercise management system 200.

In an example embodiment, the wearable device 100 may be worn on the body of the user to assist the user with their movement in a walking assistance mode. For example, the wearable device 100 may be worn on legs of the user to generate an assistance force for assisting the user with a movement of the legs and assist the user in walking.

In an example embodiment, to enhance an exercise effect on the user in an exercise assistance mode, the wearable device 100 may generate a resistance force for hindering a physical movement of the user or an assistance force for assisting a physical movement of the user, and apply the generated resistance force or the generated assistance force to the body of the user. For example, in the exercise assistance mode, the user may select, through the electronic device 210, an exercise program (e.g., squat, lunge, running, walking, stretching, etc.) with which the user attempts to do an exercise using the wearable device 100, and/or an exercise intensity to be applied to the wearable device 100. The wearable device 100 may control a driving module of the wearable device 100 according to the exercise program selected by the user and obtain sensor data including movement information of the user through a sensor module. The wearable device 100 may adjust the strength of the resistance force or the assistance force to be applied to the user according to the exercise intensity selected by the user. For example, the wearable device 100 may control the driving module to generate a resistance force corresponding to the exercise intensity selected by the user.

In an example embodiment, the wearable device 100 may be used to measure a physical ability of the user through interworking with the electronic device 210. The wearable device 100 may operate in a physical ability measurement mode which is a mode for measuring a physical ability of the user under the control of the electronic device 210 and may transmit sensor data obtained by a movement of the user in the physical ability measurement mode to electronic device 210. The electronic device 210 may then estimate the physical ability of the user by analyzing the sensor data received from the wearable device 100.

The electronic device 210 may communicate with the wearable device 100, and remotely control the wearable device 100 or provide the user with state information associated with a state (e.g., a booting state, a charging state, a sensing state, and an error state) of the wearable device 100. The electronic device 210 may receive the sensor data obtained by a sensor of the wearable device 100 from the wearable device 100 and estimate a physical ability of the user or a result of an exercise performed by the user based on the received sensor data.

In an example embodiment, the electronic device 210 may execute a program (e.g., an application) for controlling the wearable device 100, and the user may adjust, through the program, an operation of the wearable device 100 or setting values (e.g., an intensity of torque output from the driving module (e.g., the driving modules 35 and 45 of FIG. 3), a size of audio output from a sound output module (e.g., a sound output module 550 of FIGS. 5A and 5B), and a brightness of a lighting unit (e.g., a lighting unit 85 of FIG. 3)). The program executed on the electronic device 210 may provide a GUI for an interaction with the user. The electronic device 210 may be a device in one of various type. The electronic device 210 may include, as non-limiting examples, a portable communication device (e.g., a smartphone), a computer device, a portable multimedia device, or a home appliance (e.g., a television (TV), an audio device, and a projector device).

According to an example embodiment, the electronic device 210 may be connected to the server 230 using short-range wireless communication or cellular communication. The server 230 may receive user profile information of the user using the wearable device 100 from the electronic device 210 and store and manage the received user profile information. The user profile information may include, for example, information about at least one of name, age, gender, height, weight, or body mass index (BMI) of the user. The server 230 may receive, from the electronic device 210, exercise history information about an exercise performed by the user, and store and manage the received exercise history information. The server 230 may provide the electronic device 210 with various exercise programs or physical ability measurement programs that may be provided to the user.

According to an example embodiment, the wearable device 100 and/or the electronic device 210 may be connected to the other wearable device 220. The other wearable device 220 may include, as non-limiting examples, wireless earphones 222, a smartwatch 224, or smart glasses 226. In an example embodiment, the smartwatch 224 may measure a biosignal including heart rate information of the user and transmit the measured biosignal to the electronic device 210 and/or the wearable device 100. The electronic device 210 may estimate the heart rate information (e.g., current heart rate, maximum heart rate, and average heart rate) of the user based on the biosignal received from the smartwatch 224 and provide the estimated heart rate information to the user.

In an example embodiment, the exercise result information or physical ability information that is evaluated through the electronic device 210 may be transmitted to the other wearable device 220 to be provided to the user through the other wearable device 220. The state information of the wearable device 100 may also be transmitted to the other wearable device 220 to be provided to the user through the other wearable device 220. In an example embodiment, the wearable device 100, the electronic device 210, and the other wearable device 220 may be connected to each other through wireless communication (e.g., Bluetooth communication and Wi-Fi communication).

In an example embodiment, the wearable device 100 may provide (or output) feedback (e.g., visual feedback, auditory feedback, and/or tactile feedback) corresponding to the state of the wearable device 100 according to a control signal received from the electronic device 210. For example, the wearable device 100 may provide visual feedback through the lighting unit (e.g., the lighting unit 85 of FIG. 3) and auditory feedback through the sound output module (e.g., the sound output module 550 of FIGS. 5A and 5B). The wearable device 100 may include a haptic module and provide tactile feedback in the form of vibration to the body of the user through the haptic module. The electronic device 210 may also provide (or output) feedback (e.g., visual feedback, auditory feedback, and/or tactile feedback) corresponding to the state of the wearable device 100.

In an example embodiment, the electronic device 210 may present a personalized exercise goal to the user in the exercise assistance mode. The personalized exercise goal may include a target exercise amount for each exercise type (e.g., a muscle strengthening exercise (or weight exercise), a balance exercise, an aerobic exercise (or cardio exercise)) that the user attempts to do, which may be determined by the electronic device 210 and/or the server 230. When the server determines the target exercise amount, the server 230 may transmit information about the determined target exercise amount to the electronic device 210. The electronic device 210 may then personalize and present a target exercise amount for an exercise type (e.g., the muscle strengthening exercise, the balance exercise, and the aerobic exercise) according to an exercise program (e.g., squat, lunge, and running) the user attempts to perform and/or physical characteristics (e.g., age, height, weight, and BMI) of the user. The electronic device 210 may display, on a display, a graphical user interface (GUI) screen that displays the target exercise amount for each exercise type.

In an example embodiment, the electronic device 210 and/or the server 230 may include a database (DB) in which information about a plurality of exercise programs to be provided to the user through the wearable device 100 is stored. The electronic device 210 and/or the server 230 may store and manage the exercise program performed by the user, a result of performing the exercise program, and the like.

In an example embodiment, the electronic device 210 and/or the server 230 may provide the user with various exercise programs for the user to achieve their exercise goal in various exercise environments desired by the user. The exercise goal may include, for example, at least one of improving muscular strength, improving muscular physical strength, improving cardiovascular endurance, improving cardiovascular endurance, improving core stability, improving flexibility, improving symmetry, or a combination thereof.

In an example embodiment, the electronic device 210 and/or the server 230 may recommend exercise programs to the user for the user to achieve the exercise goal of the user. Each of the exercise programs may include one or more exercise modes. For example, each of the exercise modes may relate to a physical movement for the user to achieve a specific exercise goal. For example, running may be an exercise mode for improving cardiovascular endurance of the user. For example, lunge may be an exercise mode for improving core stability of the user. There may be various combinations of a plurality of exercise modes included in each of the exercise programs according to an exercise goal of the user. The electronic device 210 may provide the user with various exercise programs according to a combination of the exercise modes, even for the same exercise goal.

In an example embodiment, a plurality of exercise modes may be databased and stored in the electronic device 210 and/or the server 230. The electronic device 210 and/or the server 230 may generate a plurality of exercise programs based on various pieces of information about the user and recommend, to the user, a target exercise program among the plurality of exercise programs in consideration of an exercise goal of the user or an exercise performance state of the user. For example, the electronic device 210 and/or the server 230 may determine the target exercise program to be recommended to the user based on at least one of an exercise goal, an exercise history, or an exercise performance result of the user. Accordingly, even when doing an exercise every day under the same exercise goal, the user may be recommended a new exercise program, and the user may thus feel as if they perform a different exercise than before by performing the new exercise program.

In an example embodiment, when the user is doing an exercise with the wearable device 100 worn on the body of the user, the electronic device 210 may calculate an exercise amount achievement estimate that is achieved by the user from the exercise based on sensor data received from the wearable device 100, and provide the calculated exercise amount achievement estimate through a GUI. For example, when the user is performing the exercise while a resistance force is being applied to the user through the wearable device 100 to enhance an effect of the exercise, the electronic device 210 may calculate an additional exercise amount achievement estimate by the resistance force and may provide the calculated exercise amount achievement estimate through the GUI by being distinguished from the exercise amount achievement estimate. For example, the additional exercise amount achievement estimate may correspond to an additional calorie consumption estimate indicating calories additionally consumed by the resistance force of the wearable device 100. Rather than simply providing the exercise amount achievement estimate that is based on the number of times of motions or the number of times of doing the exercise, the electronic device 210 may provide the additional exercise amount achievement estimate that is additionally achieved by the provision of the resistance force by the wearable device 100, along with the exercise amount achievement estimate obtained when there is no exercise assistance by the provision of the resistance force by the wearable device 100. Accordingly, the electronic device 210 may increase the interest of the user in doing the exercise with the wearable device 100 worn on the body of the user, and provide exercise result information that is significant to the user.

Figure 4:
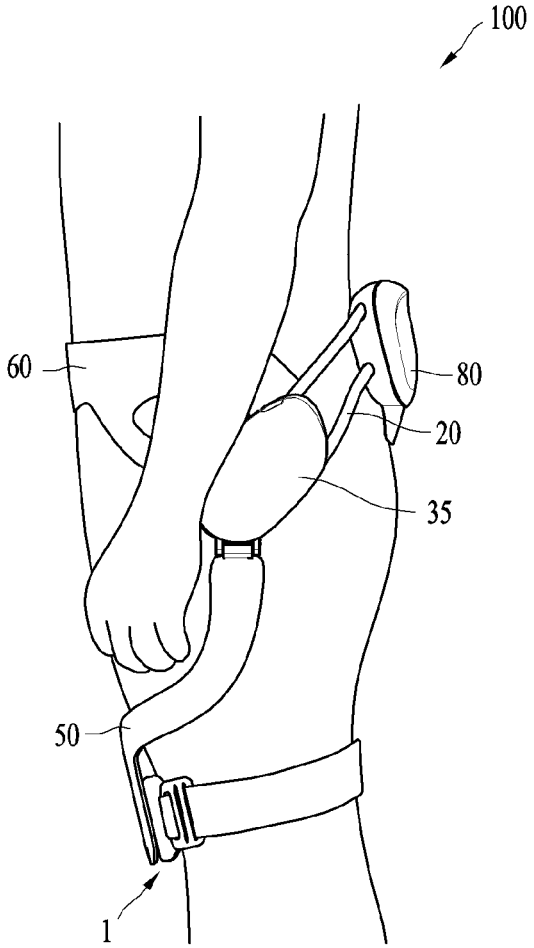
FIG. 4 is a left side view of an example of a wearable device according to an example embodiment.

FIG. 3 is a rear view of an example of a wearable device according to an example embodiment, and FIG. 4 is a left side view of an example of a wearable device according to an example embodiment.

According to an example embodiment, referring to FIGS. 3 and 4, the wearable device 100 may include a base body 80, a waist support frame 20, driving modules 35 and 45, leg support frames 50 and 55, thigh fasteners 1 and 2, and a waist fastener 60. The base body 80 may include a lighting unit 85. In an example embodiment, at least one of these components (e.g., the lighting unit 85) may be omitted from or at least one other component (e.g., a fastening detection module) may be added to the wearable device 100.

The base body 80 may be positioned on the waist of the user while the wearable device 100 is worn on a body of a user. The base body 80 may be positioned on the waist of the user to provide a cushioning feeling to the waist of the user and support the waist of the user. The base body 80 may be hung around buttocks of the user such that the wearable device 100 does not escape downward by gravity while the wearable device 100 is worn on the user. The base body 80 may distribute a portion of the weight of the wearable device 100 to the waist of the user while the wearable device 100 is worn on the user. The base body 80 may be connected to the waist support frame 20. At both ends of the base body 80, a waist support frame connection element (not shown) that may be connected to the waist support frame 20 may be provided.

In an example embodiment, the lighting unit 85 may be disposed outside the base body 80. The lighting unit 85 may include a light source (e.g., a light-emitting diode (LED)). The lighting unit 85 may emit light under the control of a control module (not shown) (e.g., a control module 510 of FIGS. 5A and 5B). Depending on an example embodiment, the control module may control the lighting unit 85 to provide (or output) visual feedback corresponding to a state of the wearable device 100 to the user through the lighting unit 85.

The waist support frame 20 may extend from both ends of the base body 80. Inside the waist support frame 20, the waist of the user may be accommodated. The waist support frame 20 may include at least one rigid body beam. Each beam may be provided in a curved shape having a preset curvature to surround the waist of the user. The waist fastener 60 may be connected to an end of the waist support frame 20. The driving modules 35 and 45 may be connected to the waist support frame 20.

In an example embodiment, the control module (not shown), an IMU (not shown) (e.g., the IMU 135 of FIG. 1 and an IMU 522 of FIG. 5B), a communication module (not shown) (e.g., a communication module 516 of FIGS. 5A and 5B), and a battery (not shown) may be disposed inside the base body 80. The base body 80 may protect the control module, the IMU, the communication module, and the battery. The control module may generate a control signal for controlling an operation of the wearable device 100. The control module may include a control circuit including a processor and a memory to control actuators of the driving modules 35 and 45. The control module may further include a power supply module (not shown) to supply power of the battery to each of the components of the wearable device 100.

In an example embodiment, the wearable device 100 may include a sensor module (not shown) (e.g., a sensor module 520 of FIG. 5A) configured to obtain sensor data from at least one sensor. The sensor module may obtain the sensor data that changes according to a movement of the user. In an example embodiment, the sensor module may obtain the sensor data including movement information of the user and/or movement information of components of the wearable device 100. The sensor module may include, for example, an IMU (e.g., the IMU 135 of FIG. 1 or an IMU 522 of FIG. 5B) for measuring an upper body movement value of the user or a movement value of the waist support frame 20, and an angle sensor (e.g., the angle sensor 125 of FIG. 1, and a first angle sensor 520 and a second angle sensor 520-1 of FIG. 5B) for measuring a hip joint angle value of the user or a movement value of the leg support frames 50 and 55, but is not limited thereto. The sensor module may further include, for example, at least one of a position sensor, a temperature sensor, a biosignal sensor, or a proximity sensor.

The waist fastener 60 may be connected to the waist support frame 20 to fasten the waist support frame 20 to the waist of the user. The waist fastener 60 may include, for example, a pair of belts.

The driving modules 35 and 45 may generate an external force (or torque) to be applied to the body of the user based on the control signal generated by the control module. For example, the driving modules 35 and 45 may generate an assistance force or a resistance force to be applied to the legs of the user. In an example embodiment, the driving modules 35 and 45 may include a first driving module 45 disposed at a position corresponding to a position of a right hip joint of the user and a second driving module 35 disposed at a position corresponding to a position of a left hip joint of the user. The first driving module 45 may include a first actuator and a first joint member, and the second driving module 35 may include a second actuator and a second joint member. The first actuator may provide power to be transmitted to the first joint member, and the second actuator may provide power to be transmitted to the second joint member. The first actuator and the second actuator may each include a motor configured to generate power (or torque) by receiving power from the battery. When powered and driven, the motor may generate a force (e.g., the assistance force) for assisting a physical movement of the user or a force (e.g., the resistance force) for hindering a physical movement of the user. In an example embodiment, the control module may adjust a voltage and/or current to be supplied to the motor to adjust the intensity and direction of the force to be generated by the motor.

In an example embodiment, the first joint member and the second joint member may receive power from the first actuator and the second actuator, respectively, and may apply an external force to the body of the user based on the received power. The first joint member and the second joint member may be disposed at corresponding positions of joint portions of the user, respectively. One side of the first joint member may be connected to the first actuator, and the other side thereof may be connected to a first leg support frame 55. The first joint member may be rotated by the power received from the first actuator. An encoder or a Hall sensor that may operate as the angle sensor for measuring a rotation angle (corresponding to a joint angle of the user) of the first joint member may be disposed on one side of the first joint member. One side of the second joint member may be connected to the second actuator, and the other side thereof may be connected to a second leg support frame 50. The second joint member may be rotated by the power received from the second actuator. An encoder or a Hall sensor that may operate as the angle sensor for measuring a rotation angle (corresponding to a joint angle of the user) of the second joint member may be disposed on one side of the second joint member.

In an example embodiment, the first actuator may be disposed in a lateral direction of the first joint member, and the second actuator may be disposed in a lateral direction of the second joint member. A rotation axis of the first actuator and a rotation axis of the first joint member may be disposed to be separate from each other, and a rotation axis of the second actuator and a rotation axis of the second joint member may also be disposed to be separate from each other. However, examples are not limited thereto, and each actuator and each joint member may share a rotation axis. In an example embodiment, each actuator may be disposed to be separate from each joint member. In this case, the driving modules 35 and 45 may further include a power transmission module (not shown) configured to transmit power from the respective actuators to the respective joint members. The power transmission module may be a rotary body (e.g., a gear), or a longitudinal member (e.g., a wire, a cable, a string, a spring, a belt, or a chain). However, the scope of examples is not limited to the foregoing positional relationship between the actuators and the joint members, and the foregoing power transmission structure.

In an example embodiment, the leg support frames 50 and 55 may support the legs (e.g., thighs) of the user when the wearable device 100 is worn on the legs of the user. For example, the leg support frames 50 and 55 may transmit power (e.g., torque) generated by the driving modules 35 and 45 to the thighs of the user, and the power may act as an external force to be applied to a movement of the legs of the user. As one end of the leg support frames 50 and 55 is connected to a joint member to be rotated and the other end of the leg support frames 50 and 55 is connected to thigh fasteners 1 and 2, the leg support frames 50 and 55 may transmit the power generated by the driving modules 35 and 45 to the thighs of the user while supporting the thighs of the user. For example, the leg support frames 50 and 55 may push or pull the thighs of the user. The leg support frames 50 and 55 may extend in a longitudinal direction of the thighs of the user. The leg support frames 50 and 55 may be bent to wrap at least a portion of the circumference of the thighs of the user. The leg support frames 50 and 55 may include the first leg support frame 55 for supporting the right leg of the user and the second leg support frame 50 for supporting the left leg of the user.

The thigh fasteners 1 and 2 may be connected to the leg support frames 50 and 55 and may fix the leg support frames 50 and 55 to the thighs of the user. The thigh fasteners 1 and 2 may include a first thigh fastener 2 for fixing the first leg support frame 55 to the right thigh of the user, and a second thigh fastener 1 for fixing the second leg support frame 50 to the left thigh of the user.

In an example embodiment, the first thigh fastener 2 may include a first cover, a first fastening frame, and a first strap. The second thigh fastener 1 may include a second cover, a second fastening frame, and a second strap. The first cover and the second cover may apply torque generated by the driving modules 35 and 45 to the thighs of the user. The first cover and the second cover may be disposed on one side of the thighs of the user to push or pull the thighs of the user. The first cover and the second cover may be disposed on a front surface of the thighs of the user. The first cover and the second cover may be disposed along a circumferential direction of the thighs of the user. The first cover and the second cover may extend to both sides around the other ends of the leg support frames 50 and 55 and may include curved surfaces corresponding to the thighs of the user. One ends of the first cover and the second cover may be connected to corresponding fastening frames, and the other ends thereof may be connected to corresponding straps.

For example, the first fastening frame and the second fastening frame may be disposed to surround at least a portion of the circumference of the thighs of the user to prevent or reduce the chance of the thighs of the user from escaping from the leg support frames 50 and 55. The first fastening frame may have a fastening structure that connects the first cover and the first strap, and the second fastening frame may have a fastening structure that connects the second cover and the second strap.

The first strap may surround a remaining portion of the circumference of the right thigh of the user that is not covered by the first cover and the first fastening frame, and the second strap may surround a remaining portion of the circumference of the left thigh of the user that is not covered by the second cover and the second fastening frame. The first strap and the second strap may each include, for example, an elastic material (e.g., a band).

Figure 5A:
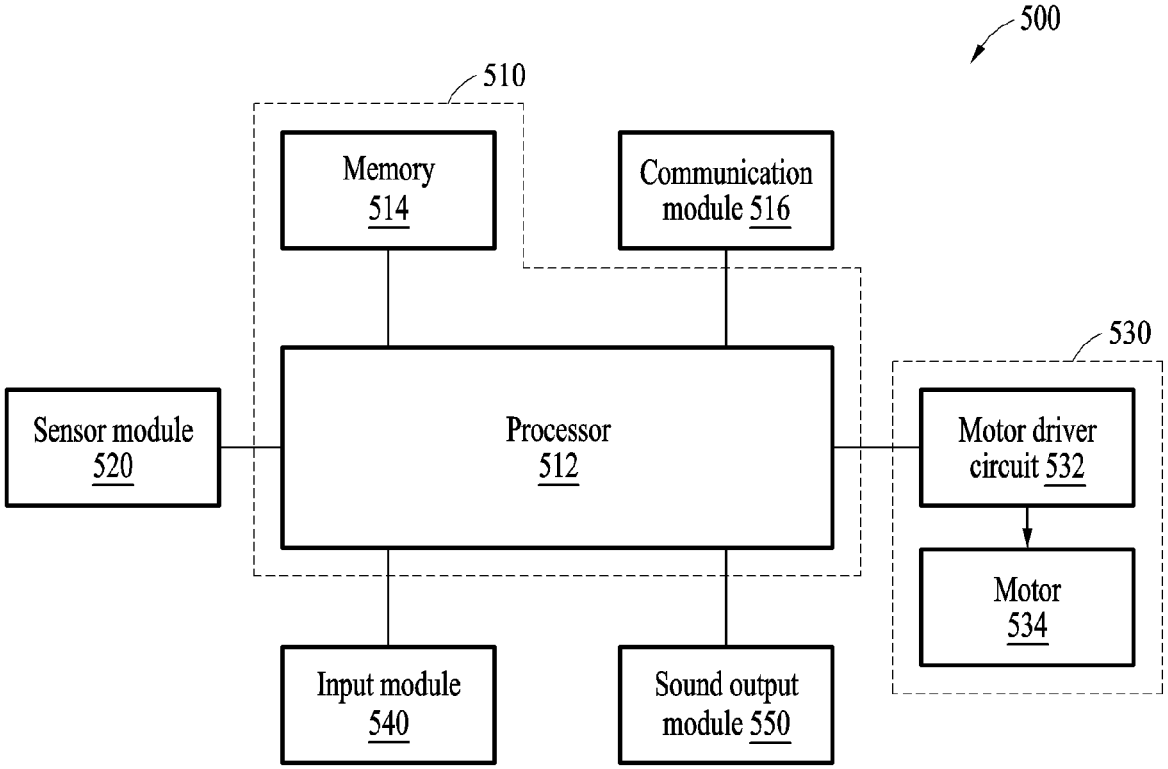
FIGS. 5A and 5B are diagrams illustrating example configurations of a control system of a wearable device according to an example embodiment.
Figure 5B:
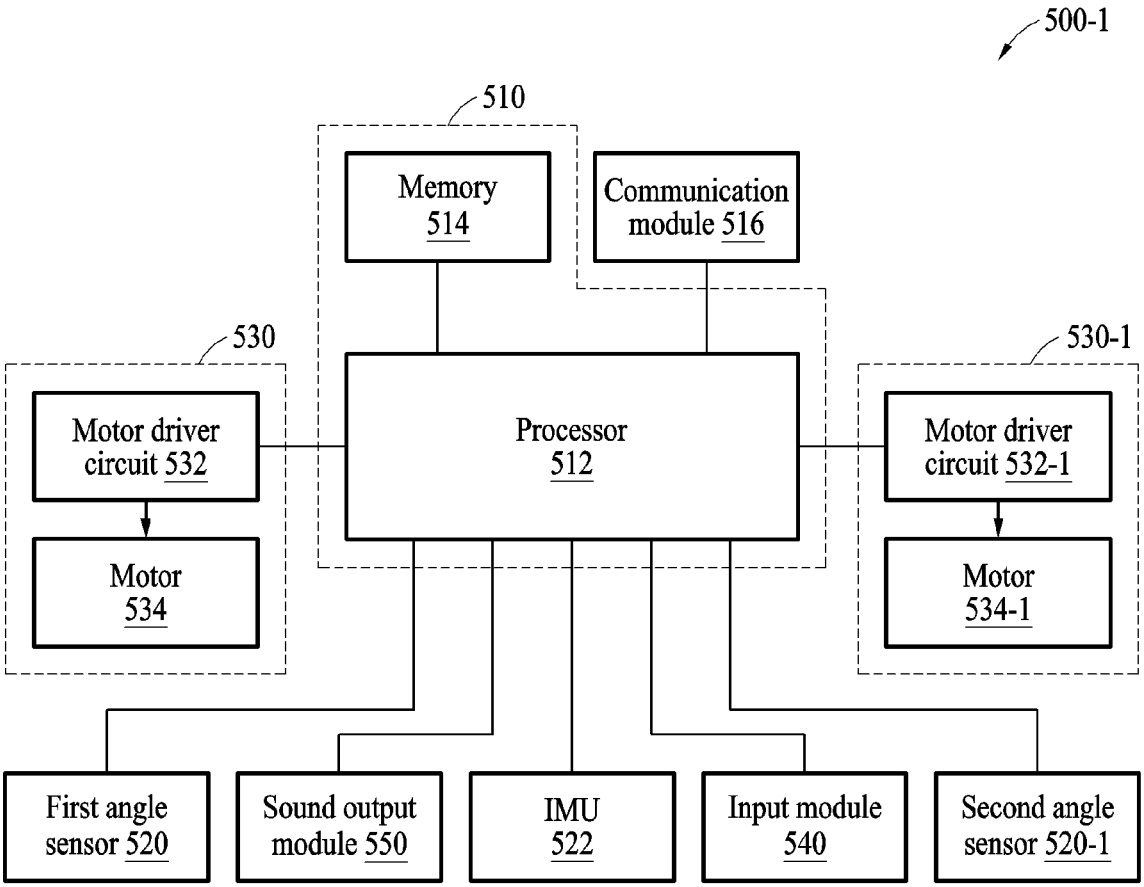

FIGS. 5A and 5B are diagrams illustrating example configurations of a control system of a wearable device according to an example embodiment.

Referring to FIG. 5A, the wearable device 100 may be controlled by a control system 500. The control system 500 may include a control module 510, a communication module 516, a sensor module 520, a driving module 530, an input module 540, and a sound output module 550. In an example embodiment, at least one of these components (e.g., the sound output module 550) may be omitted or at least one other component (e.g., the lighting unit 85 of FIG. 3) may be added to the control system 500.

The driving module 530 may include a motor 534 configured to generate power (e.g., torque) and a motor driver circuit 532 configured to drive the motor 534. Although a driving module (e.g., the driving module 530) is illustrated as including a single motor driver circuit (e.g., the motor driver circuit 532) and a single motor (e.g., the motor 534) in FIG. 5A, examples of which are not limited thereto. For example, as shown in FIG. 5B, a driving module (e.g., a driving module 530-1) of a control system 500-1 may include a plurality of (e.g., two or more) motor driver circuits (e.g., motor driver circuits 532 and 532-1) and motors (e.g., motors 534 and 534-1). The driving module 530 including the motor driver circuit 532 and the motor 534 may correspond to the first driving module 45 of FIG. 3, and the driving module 530-1 including the motor driver circuit 532-1 and the motor 534-1 may correspond to the second driving module 35 of FIG. 3. The following description of each of the motor driver circuit 532 and the motor 534 may also be applied to the motor driver circuit 532-1 and the motor 534-1 shown in FIG. 5B.

Referring back to FIG. 5A, the sensor module 520 may include a sensor circuit including at least one sensor. The sensor module 520 may include sensor data including movement information of a user or movement information of the wearable device 100. The sensor module 520 may transmit the obtained sensor data to the control module 510. The sensor module 520 may include an IMU 522 and an angle sensor (e.g., a first angle sensor 520 and a second angle sensor 520-1), as shown in FIG. 5B.

The IMU 522 may measure an upper body movement value of the user. For example, the IMU 522 may sense X-axis, Y-axis, and Z-axis acceleration, and sense X-axis, Y-axis, and Z-axis angular velocity according to a movement of the user. In addition, the IMU 522 may obtain a movement value (e.g., an acceleration value and an angular velocity value) of a waist support frame (e.g., the waist support frame 20 of FIG. 3) of the wearable device 100. The movement value of the waist support frame may correspond to the upper body movement value of the user.

The angle sensor may measure a hip joint angle value of the user according to a movement of the legs of the user. The sensor data that may be measured by the angle sensor may include, for example, a hip joint angle value of a right leg, a hip joint angle value of a left leg, and information about a direction of a movement of the legs. For example, the first angle sensor 520 of FIG. 5B may obtain the hip joint angle value of the right leg of the user, and the second angle sensor 520-1 may obtain the hip joint angle value of the left leg of the user. The first angle sensor 520 and the second angle sensor 520-1 may each include an encoder and/or a Hall sensor, for example. The angle sensor may also obtain a movement value of a leg support frame of the wearable device 100. For example, the first angle sensor 520 may obtain a movement value of the first leg support frame 55, and the second angle sensor 520-1 may obtain a movement value of the second leg support frame 50. The movement value of the leg support frame may correspond to the hip joint angle value.

In an example embodiment, the sensor module 520 may further include at least one of a position sensor for obtaining a position value of the wearable device 100, a proximity sensor for detecting proximity of an object, a biosignal sensor for detecting a biosignal of the user, or a temperature sensor for measuring an ambient temperature.

The input module 540 may receive a command or data to be used by a component (e.g., a processor 512) of the wearable device 100 from the outside (e.g., the user) of the wearable device 100. The input module 540 may include an input component circuit. The input module 540 may include, for example, a key (e.g., a button) or a touchscreen.

The sound output module 550 may output a sound signal to the outside of the wearable device 100. The sound output module 550 may include a speaker that reproduces a guide voice for an audible notification of a guide sound signal (e.g., a driving start sound, a motion error notification sound, or an exercise start notification sound), music content, or specific information (e.g., exercise result information and physical ability evaluation information).

In an example embodiment, the control system 500 may further include a battery (not shown) for supplying power to each component of the wearable device 100. The wearable device 100 may convert power of the battery according to an operating voltage of each component of the wearable device 100 and supply the converted power to each component.

The driving module 530 may generate an external force to be applied to the legs of the user under the control of the control module 510. The driving module 530 may generate torque to be applied to the legs of the user based on a control signal generated by the control module 510. The control module 510 may transmit the control signal to the motor driver circuit 532. The motor driver circuit 532 may control an operation of the motor 534 by generating a current signal (or a voltage signal) corresponding to the control signal and supplying the generated current signal to the motor 534. As circumstances require, the current signal may not be supplied to the motor 534. When the motor 534 is driven as the current signal is supplied to the motor 534, the motor 534 may generate torque for an assistance force for assisting a movement of the legs of the user or a resistance force for hindering a movement of the legs of the user.

The control module 510 may control an overall operation of the wearable device 100 and may generate a control signal for controlling each component (e.g., the communication module 516 and the driving module 530). The control module 510 may include a processor 512 and a memory 514.

For example, the processor 512 may execute software to control at least one other component (e.g., a hardware or software component) of the wearable device 100 connected to the processor 512 and may perform various types of data processing or computation. The software may include an application for providing a GUI. According to an example embodiment, as at least a part of data processing or computation, the processor 512 may store instructions or data received from another component (e.g., the communication module 516) in the memory 514, process the instructions or data stored in the memory 514, and store resulting data obtained by the processing in the memory 514. According to an example embodiment, the processor 512 may include, for example, a main processor (e.g., a central processing unit (CPU) or an application processor (AP)) or an auxiliary processor (e.g., a graphics processing unit (GPU), a neural processing unit (NPU), an image signal processor (ISP), a sensor hub processor, or a communication processor (CP)) that is operable independently of, or in conjunction with, the main processor. The auxiliary processor may be implemented separately from the main processor or as a part of the main processor.

The memory 514 may store various pieces of data used by at least one component (e.g., the processor 512) of the control module 510. The data may include, for example, input data or output data for software, sensor data, and instructions related thereto. The memory 514 may include a volatile memory or a non-volatile memory (e.g., a random-access memory (RAM), a dynamic RAM (DRAM), or a static RAM (SRAM)).

The communication module 516 may support establishment of a direct (e.g., wired) communication channel or a wireless communication channel between the control module 510 and another component of the wearable device 100 or an external electronic device (e.g., the electronic device 210 or the other wearable device 220 of FIG. 2), and support communication through the established communication channel. The communication module 516 may include a communication circuit for performing a communication function. For example, the communication module 516 may receive a control signal from an electronic device (e.g., the electronic device 210) and transmit the sensor data obtained by the sensor module 520 to the electronic device. The communication module 516 may include at least one CP (not shown) that is operable independently of the processor 512 and that supports the direct (e.g., wired) communication or the wireless communication. According to an example embodiment, the communication module 516 may include a wireless communication module (e.g., a cellular communication module, a short-range wireless communication module, or a global navigation satellite system (GNSS) communication module), and/or a wired communication module. A corresponding one of these communication modules may communicate with another component of the wearable device 100 and/or an external electronic device via a short-range communication network (e.g., Bluetooth™, wireless-fidelity (Wi-Fi), or infrared data association (IrDA)), or a long-range communication network (e.g., a legacy cellular network, a 5G network, a next-generation communication network, the Internet, or a computer network (e.g., a local area network (LAN) or a wide area network (WAN)).

According to an example embodiment, the wearable device 100 that assists the user in doing an exercise may include the driving module 530 configured to generate torque to be applied to the body of the user. The wearable device 100 may further include a support frame (e.g., of or including one or more of the leg support frame(s) 50 and 55, and/or the waist support frame 20, as shown in FIG. 3 for example) for supporting the body of the user when the wearable device 100 is worn on the body of the user and transmitting the generated torque to the body of the user. The wearable device 100 may further include the sensor module 520 configured to obtain sensor data including movement information of the user wearing the wearable device 100. The wearable device 100 may further include the communication module 516 configured to receive setting data on an exercise intensity selected by a user input from the electronic device 210 and transmit the sensor data obtained by the sensor module 520 to the electronic device 210. The wearable device 100 may further include the control module 510 configured to control the driving module 530 based on the selected exercise intensity indicated in the received setting data.

In an example embodiment, the control module 510 may control the communication module 516 to transmit the sensor data to the electronic device 210, and may thereby allow the electronic device 210 to estimate an exercise amount of the user based on the sensor data and the exercise intensity selected by the user, generate an exercise activity indicator (e.g., an exercise activity indicator 1350 of FIG. 13) including one or more graphic indicators (e.g., graphic indicators 1360, 1370, and 1380 of FIG. 13) for indicating the estimated exercise amount, and output a GUI on which the exercise activity indicator is displayed. In an example embodiment, the one or more graphic indicators may include a first graphic element (e.g., a first graphic element 1362 in FIGS. 13-14) corresponding to a target exercise amount to be achieved by the user through an exercise, a second graphic element (e.g., a second graphic element 1364 in FIGS. 13-14) corresponding to an exercise amount achievement estimate that is achieved by the user doing the exercise without the selected exercise intensity being applied, and a third graphic element (e.g., a third graphic element 1366 in FIGS. 13-14) corresponding to an additional exercise amount achievement estimate that is achieved by the user doing the exercise with the selected exercise intensity being applied. The exercise activity indicator provided through the electronic device 210 will be described in more detail below with reference to FIGS. 13 to 15C.

Figure 6:
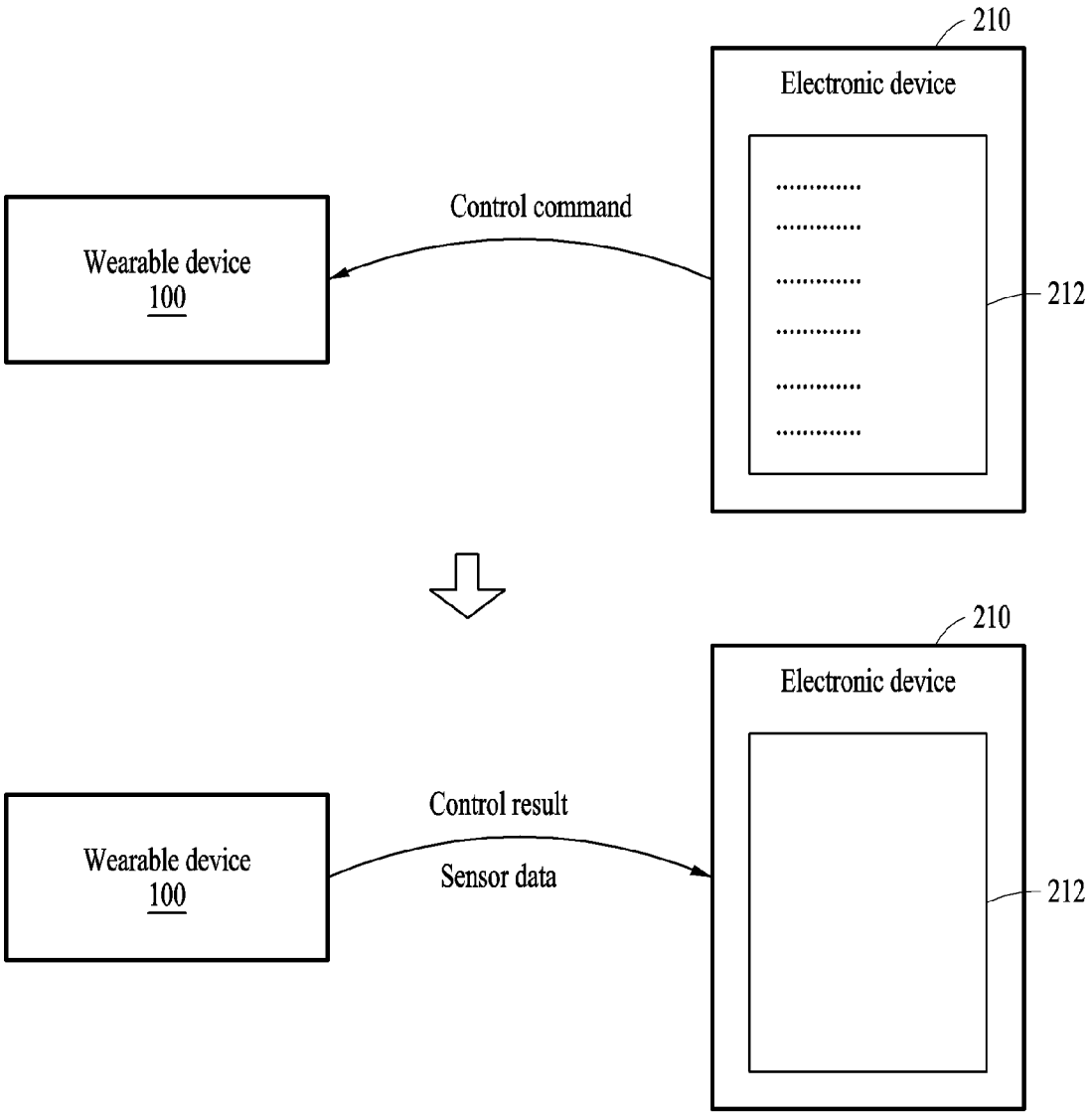
FIG. 6 is a diagram illustrating an example of an interaction between a wearable device and an electronic device according to an example embodiment.

FIG. 6 is a diagram illustrating an example of an interaction between a wearable device and an electronic device according to an example embodiment.

Referring to FIG. 6, the wearable device 100 may communicate with the electronic device 210. For example, the electronic device 210 may be a user terminal of a user who uses the wearable device 100, or a dedicated controller for the wearable device 100. According to an example embodiment, the wearable device 100 and the electronic device 210 may be connected to each other through short-range wireless communication (e.g., Bluetooth communication or Wi-Fi communication).

In an example embodiment, the electronic device 210 may execute an application for checking a state of the wearable device 100 or controlling or operating the wearable device 100. When the application is executed, a screen of a user interface (UI) for controlling an operation of the wearable device 100 or determining an operation mode of the wearable device 100 may be displayed on a display 212 of the electronic device 210. The UI may be a graphical user interface (GUI), for example.

In an example embodiment, the user may input a command (e.g., a command for executing a walking assistance mode, an exercise assistance mode, or a physical ability measurement mode) for controlling the operation of the wearable device 100 or change settings of the wearable device 100, through the screen of the GUI on the display 212 of the electronic device 210. The electronic device 210 may generate a control command (or a control signal) corresponding to an operation control command or a settings change command that is input by the user and transmit the generated control command to the wearable device 100. The wearable device 100 may operate according to the received control command and may transmit, to the electronic device 210, a control result obtained in response to the control command and/or sensor data measured by the sensor module of the wearable device 100. The electronic device 210 may provide, to the user through the screen of the GUI, resulting information (e.g., walking ability information, exercise ability information, and physical ability evaluation information) derived by analyzing the control result and/or the sensor data.

Figure 7:
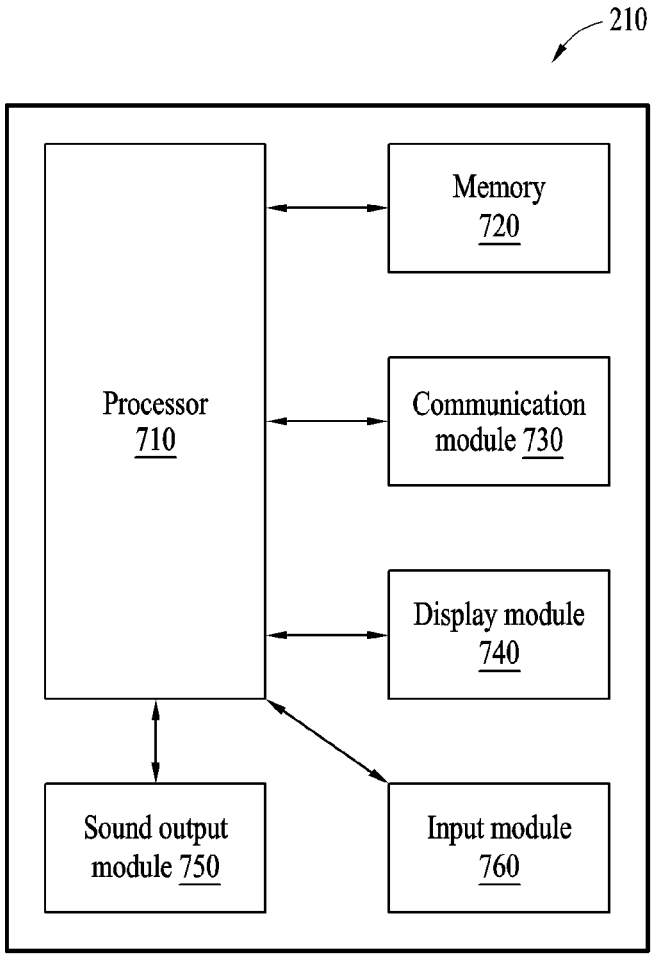
FIG. 7 is a diagram illustrating an example configuration of an electronic device according to an example embodiment.

FIG. 7 is a diagram illustrating an example configuration of an electronic device according to an example embodiment.

Referring to FIG. 7, the electronic device 210 may include a processor 710, a memory 720, a communication module 730, a display module 740, a sound output module 750, and an input module 760. In an example embodiment, at least one of these components (e.g., the sound output module 750) may be omitted from or at least one other component (e.g., a sensor module and a battery) may be added to the electronic device 210.

The processor 710 may control at least one other component (e.g., a hardware or software component) of the electronic device 210 and may perform various types of data processing or computation. According to an example embodiment, as at least a part of data processing or computation, the processor 710 may store instructions or data received from another component (e.g., the communication module 730 comprising communication circuitry) in the memory 720, process the instructions or data stored in the memory 720, and store resulting data in the memory 720.

The processor 710 may include, for example, a main processor (e.g., a CPU or an AP) or an auxiliary processor (e.g., a GPU, a NPU, an ISP, a sensor hub processor, or a CP) that is operable independently of, or in conjunction with, the main processor.

The memory 720 may store various pieces of data used by at least one component (e.g., the processor 710 and/or the communication module 730) of the electronic device 210. The data may include, for example, input data or output data for a program (e.g., an application) and instructions related thereto. The memory 720 may include at least one instruction executable by the processor 710. The memory 720 may include a volatile memory or a non-volatile memory.

The communication module 730 may support the establishment of a direct (e.g., wired) communication channel or a wireless communication channel between the electronic device 210 and another electronic device (e.g., the wearable device 100, the other wearable device 220, and/or the server 230 as shown in FIG. 2 for example), and support the communication via the established communication channel. The communication module 730 may include a communication circuit for performing a communication function. The communication module 730 may include at least one communication processor (CP) that is operable independently of the processor 710 (e.g., an AP) and support direct (e.g., wired) communication or wireless communication. According to an example embodiment, the communication module 730 may include a wireless communication module (e.g., a Bluetooth communication module, a cellular communication module, a short-range wireless communication module, or a GNSS communication module) or a wired communication module (e.g., a LAN communication module or a power line communication module). A corresponding one of these communication modules may communicate with another external electronic via a first communication network (e.g., a short-range communication network, such as, Bluetooth™, wireless-fidelity (Wi-Fi) direct, or IrDA) or a second communication network (e.g., a long-range communication network, such as, a legacy cellular network, a 5G network, a next-generation communication network, the Internet, or a computer network (e.g., a LAN or a wide area network (WAN)). For example, the communication module 730 may transmit a control command to the wearable device 100 and receive at least one of sensor data including physical movement information of the user wearing the wearable device 100, state data of the wearable device 100, or control result data corresponding to the control command.

The display module 740 may visually provide information to the outside (e.g., the user) of the electronic device 210. The display module 740 may include, for example, a liquid-crystal display (LCD) or an organic light-emitting diode (OLED) display, a hologram device, or a projector device. The display module 740 may further include a control circuit for controlling driving of a display. In an example embodiment, the display module 740 may include a touch sensor configured to sense a touch, or a pressure sensor configured to measure an intensity of a force incurred by the touch.

The sound output module 750 may output a sound signal to the outside of the electronic device 210. The sound output module 750 may include a speaker that reproduces a guide sound signal (e.g., a driving start sound and an operation error notification sound), music content, or a guide voice based on a state of the wearable device 100. For example, in response to a determination that the wearable device 100 is not correctly worn on the body of the user, the sound output module 750 may output a guide voice to inform the user of the incorrect wearing or guide the user through normal wearing. For example, the sound output module 750 may output a guide voice corresponding to exercise evaluation information or exercise result information that is obtained by evaluating an exercise performed by the user.

The input module 760 may receive a command or data to be used by a component (e.g., the processor 710) of the electronic device 210 from the outside (e.g., the user) of the electronic device 210. The input module 760 may include an input component circuit and receive a user input. The input module 760 may include, for example, a key (e.g., a button) or a touchscreen.

According to an example embodiment, the electronic device 210 may include a communication module 730 configured to receive, from the wearable device 100, sensor data including movement information of the user wearing the wearable device 100 during an exercise. The electronic device 210 may further include the input module 760 configured to receive a user input that selects an exercise intensity to be applied to the exercise of the user. The electronic device 210 may further include the processor 710 configured to estimate an exercise amount of the user based on the received sensor data and the selected exercise intensity.

In an example embodiment, the processor 710 may provide a personalized target exercise amount for the user. The personalized target exercise amount may be determined based on user profile information of the user. The personalized target exercise amount may be provided to the user through a screen (e.g., a screen 1010 of FIG. 10) of a GUI. In an example embodiment, the personalized target exercise amount may be represented as a ratio between target exercise amounts for respective types of exercise the user attempts to do. For example, a ratio among a target exercise amount for a muscle strengthening exercise, a target exercise amount for an aerobic exercise, and a target exercise amount for a balance exercise may be determined according to a type of exercise the user intends to perform.

In an example embodiment, the user may select an exercise intensity to be applied to an exercise they attempt to perform through the GUI, and the processor 710 may estimate at least one of an additional exercise amount achievement estimate of the user by the selected exercise intensity or a calorie consumption estimate of the user by the selected exercise intensity, based on an exercise mode (e.g., lunge, squat, running, or walking) selected by the user and the exercise intensity selected by the user. The display module 740 may output information about at least one of the additional exercise amount achievement estimate or the calorie consumption estimate. The information about at least one of the additional exercise amount achievement estimate or the calorie consumption estimate may be provided through one screen of the GUI.

When receiving a user input that selects an exercise intensity through the input module 760, the processor 710 may control the communication module 730 to transmit setting data on the exercise intensity selected by the user to the wearable device 100 and may thereby allow the wearable device 100 to generate a resistance force or an assistance force corresponding to the selected exercise intensity during the exercise of the user. Each processor herein comprises processing circuitry.

In an example embodiment, the processor 710 may generate an exercise activity indicator (e.g., an exercise activity indicator 1350 of FIG. 13) including one or more graphic indicators (e.g., graphic indicators 1360, 1370, and 1380 of FIG. 13) for indicating an estimated exercise amount. The display module 740 may output a GUI on which the exercise activity indicator is displayed. The one or more graphic indicators may include a first graphic element corresponding to a target exercise amount to be achieved by the user through the exercise, a second graphic element corresponding to an exercise amount achievement estimate that is achieved when the user does the exercise without applying the selected exercise intensity, and a third graphic element corresponding to an additional exercise amount achievement estimate that is achieved when the user does the exercise by applying the selected exercise intensity. In an example embodiment, when there is no exercise intensity applied during the exercise of the user, the graphic indicators may include the first graphic element and the second graphic element but not include the third graphic element. The processor 710 may estimate the additional exercise amount achievement estimate based on the sensor data received from the wearable device 100 and the exercise intensity selected by the user. In an example embodiment, the processor 710 may calculate the exercise amount achievement estimate by applying a movement value (e.g., a hip joint angle value and an upper body movement value) of the user in an exercise mode performed by the user to a predefined equation for calculating an exercise amount, and may calculate the additional exercise amount achievement estimate by applying the movement value of the user and the selected exercise intensity to a predefined equation for calculating an additional exercise amount.

In an example embodiment, the exercise activity indicator provided through one screen of the GUI may include at least one of a graphic indicator (e.g., a graphic indicator 1360 of FIG. 13) corresponding to a muscle strengthening exercise amount to be achieved during the exercise of the user, a graphic indicator (e.g., a graphic indicator 1370) corresponding to an aerobic exercise amount to be achieved during the exercise of the user, or a graphic indicator (e.g., a graphic indicator 1380) corresponding to a balance exercise amount to be achieved during the exercise.

Figure 15A:
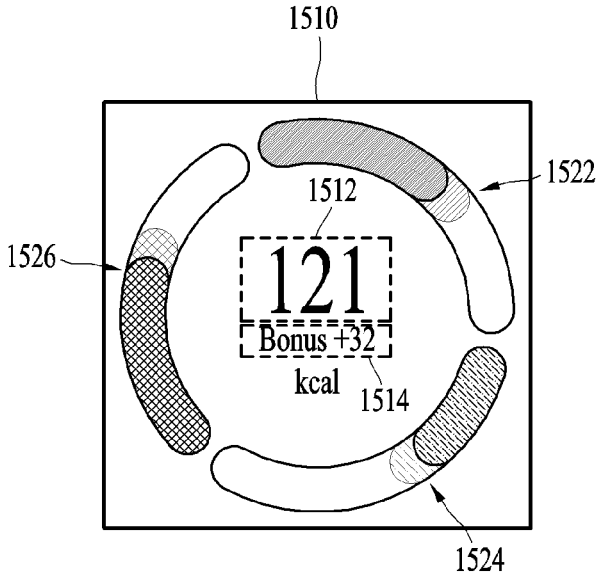
FIGS. 15A, 15B, and 15C are diagrams illustrating various examples of an exercise activity indicator according to an example embodiment.

According to an example embodiment, in the GUI, the one or more graphic indicators may be displayed in the form of an arc (e.g., graphic indicators 1522, 1524, and 1526 shown in FIG. 15A). The length of the one or more graphic indicators displayed in the GUI may be determined based on a ratio among a target exercise amount for the muscle strengthening exercise amount (or a target muscle strengthening exercise amount), a target exercise amount for the aerobic exercise amount (or a target aerobic exercise amount), and a target exercise amount for the balance exercise amount (or a target balance exercise amount). For example, when a relative target exercise amount is greater among these three types of exercise amounts (e.g., the muscle strengthening exercise amount, the aerobic exercise amount, and the balance exercise amount), a corresponding graphic indicator may be displayed as longer.

Figure 15B:
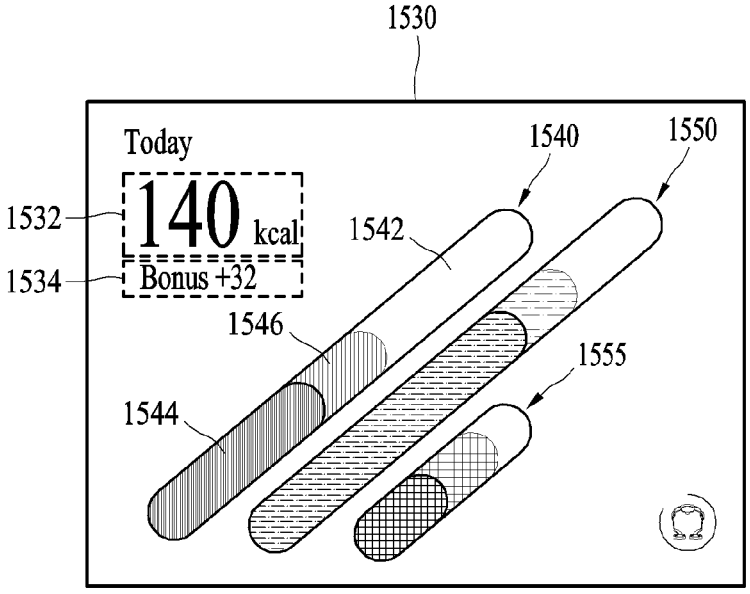

According to an example embodiment, in the GUI, the one or more graphic indicators may be displayed in the form of a bar graph or a slanted bar graph (e.g., graphic indicators 1540, 1550, and 1555 shown in FIG. 15B).

According to an example embodiment, in the GUI, the first graphic element and the second graphic element may be displayed as overlaid with each other. The second graphic element may be displayed as gradually increasing as the exercise of the user progresses. The first graphic element and the third graphic element may be displayed as overlaid with each other. The third graphic element may be displayed as adjacent to the second graphic element. For example, the third graphic element may be displayed as starting from an end point of the second graphic element. As the exercise by the user progresses, the third graphic element may be displayed as gradually increasing. In this case, the second graphic element and the third graphic element may be displayed as gradually increasing while being overlaid in an area in which the first graphic element is displayed.

According to an example embodiment, in the GUI, the second graphic element may be displayed as brighter than the first graphic element, and the third graphic element may be displayed as brighter than the second graphic element. At least two of the first graphic element, the second graphic element, and the third graphic element may be displayed in different colors and/or textures.

According to an example embodiment, in the GUI, at least two of the first graphic element, the second graphic element, and the third graphic element included in the one or more graphic indicators may be displayed with different thicknesses. For example, the thickness of the second graphic element and the thickness of the third graphic element may be greater than that of the first graphic element (e.g., refer to an exercise activity indicator 1560 of FIG. 15C), but examples are not limited thereto.

In an example embodiment, when the exercise of the user ends, the processor 710 may evaluate the exercise of the user based on the sensor data of the wearable device 100 measured during the exercise of the user and provide exercise result information of the user through one screen of the GUI. In an example embodiment, when an exercise amount achieved by the user is less than the target exercise amount, the processor 710 may determine one or more recommended exercise programs for the user. The display module 740 may then output a list of the determined one or more recommended exercise programs.

Figure 8:
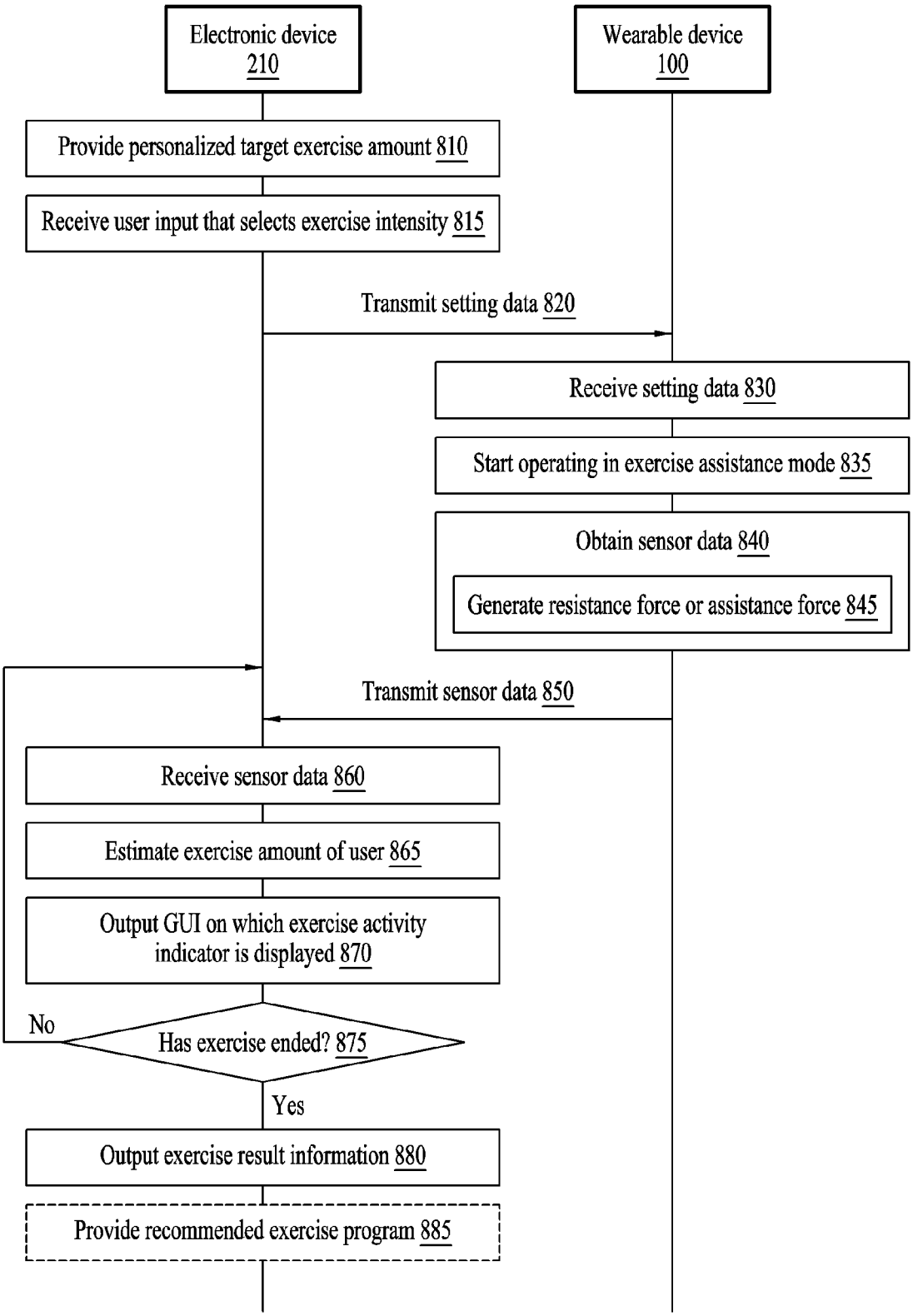
FIG. 8 is a flowchart illustrating an example of an operation method of an electronic device and a wearable device providing an exercise amount measuring function according to an example embodiment.

FIG. 8 is a flowchart illustrating an example of an operation method of an electronic device and a wearable device providing an exercise amount measuring function according to an example embodiment. In an example embodiment, at least one of operations to be described below with reference to FIG. 8 may be performed simultaneously or in parallel with another operation, and the order of the operations may be changed. In addition, at least one of the operations may be omitted, or another operation may be added.

Referring to FIG. 8, in operation 810, the electronic device 210 may provide a personalized target exercise amount for a user. The electronic device 210 may determine the target exercise amount suitable for the user based on user profile information (e.g., age, gender, and exercise history) of the user and an exercise mode selected by the user to do an exercise.

In operation 815, the electronic device 210 may receive a user input that selects an exercise intensity to be applied to the exercise of the user. In an example embodiment, there may be a basic exercise intensity that is previously determined by the exercise mode selected by the user or previous user settings, and the user may adjust the magnitude of the basic exercise intensity by manipulating a GUI provided through an application. For example, the user may select an exercise intensity that is higher than the basic exercise intensity to increase a resistance force of the wearable device 100 to be applied during the exercise. For example, the user may select an exercise intensity that is lower than the basic exercise intensity to decrease the resistance force of the wearable device 100 to be applied during the exercise or to receive an assistance force.

In an example embodiment, a target exercise amount ratio between respective exercise types (e.g., a muscle strengthening exercise, a balance exercise, and an aerobic exercise) included in the target exercise amount for the user may be changed according to the exercise intensity selected by the user. The changed target exercise amount ratio may be provided to the user through the GUI. A target exercise amount ratio of each exercise type may correspond to an exercise effect ratio of each exercise type that may be achieved when the user performs the exercise according to the selected exercise intensity.

In an example embodiment, the electronic device 210 may update the target exercise amount for the user according to the exercise intensity selected by the user, using a database (DB) that defines a target exercise amount ratio of each exercise type according to an exercise intensity for each exercise mode (e.g., lunge, reverse lunge, squat, half squat, stretching, running, and walking). For example, under the assumption that, when the user selects a first exercise intensity and performs a lunge exercise, a target exercise amount ratio of a muscle strengthening exercise, a target exercise amount ratio of an aerobic exercise, and a target exercise amount ratio of a balance exercise for the lunge exercise are 10%, 20%, and 70%, respectively, the target exercise amount ratio of the muscle strengthening exercise, the target exercise amount ratio of the aerobic exercise, and the target exercise amount ratio of the balance exercise for the lunge exercise may be updated to 20%, 15%, and 65%, respectively, when the user selects a second exercise intensity that is higher than the first exercise intensity and performs the lunge exercise according to the selected second exercise intensity. For another example, under the assumption that, when the user selects a first exercise intensity and performs a squat exercise, a target exercise amount ratio of the muscle strengthening exercise, a target exercise amount ratio of the aerobic exercise, and a target exercise amount ratio of the balance exercise for the squat exercise are 20%, 40%, and 40%, respectively, the target exercise amount ratio of the muscle strengthening exercise, the target exercise amount ratio of the aerobic exercise, and the target exercise amount ratio of the balance exercise for the squat exercise may be updated to 40%, 30%, and 30%, respectively, when the user selects a second exercise intensity that is higher than the first exercise intensity and performs the squat exercise according to the selected second exercise intensity. The updating of the target exercise amount ratio according to the exercise intensity may be performed based on the DB.

In an example embodiment, the electronic device 210 may recommend, to the user, an exercise intensity that is suitable for an exercise mode (or an exercise program) selected by the user or a physical characteristic of the user.

In operation 820, the electronic device 210 may transmit, to the wearable device 100, setting data on the exercise intensity selected by the user input. The electronic device 210 and the wearable device 100 may be connected to each other through a network. In an example embodiment, the setting data may be transmitted as being included in a control command for instructing the wearable device 100 to operate in an exercise assistance mode.

In operation 830, the wearable device 100 may receive the setting data from the electronic device 210. In operation 835, when the user starts doing the exercise with the wearable device 100 worn on the body of the user, the wearable device 100 may start operating in the exercise assistance mode. The wearable device 100 may apply a resistance force or an assistance force to the body of the user during the exercise according to what the user selects.

In operation 840, the wearable device 100 may obtain sensor data according to a movement of the user through a sensor module (e.g., the sensor module 520 of FIG. 5A). The sensor data may include, for example, information about at least one of a hip joint angle value (or a leg angle value) of the user, an upper body movement value of the user, or the number of times of performing a motion. In this case, the wearable device 100 may operate a driving module (e.g., the driving modules 35 and 45, the driving module 530, and the driving module 530-1) based on the exercise intensity selected by the user. Each driving module may comprise driving circuitry. In operation 845, the wearable device 100 may generate the resistance force or the assistance force through the driving module based on the selected exercise intensity. The wearable device 100 may adjust an intensity (e.g., maximum intensity) of torque generated by the driving module according to the selected exercise intensity. In an example embodiment, the intensity of the torque generated by the driving module may be maintained consistently during the exercise of the user or may be changed according to an exercise motion (or an exercise progress time) of the user.

In operation 850, the wearable device 100 may transmit the obtained sensor data to the electronic device 210. In an example embodiment, the wearable device 100 may transmit the sensor data to the electronic device 210 in real time or on a periodic basis during the exercise of the user.

In operation 860, the electronic device 210 may receive, from the wearable device 100, the sensor data including the movement information of the user wearing the wearable device 100 during the exercise.

In operation 865, the electronic device 210 may estimate an exercise amount of the user based on the received sensor data and the selected exercise intensity. The electronic device 210 may calculate an exercise amount achievement estimate that is achieved when the user performs the exercise without applying the exercise intensity, based on the exercise mode performed by the user and the sensor data.

The electronic device 210 may calculate an additional exercise amount achievement estimate that is achieved when the user performs the exercise by applying the selected exercise intensity, based on the exercise mode performed by the user, the sensor data, and the selected exercise intensity. In an example embodiment, the exercise amount achievement estimate and the additional exercise amount achievement estimate may be calculated using a predefined equation that uses, as a variable input value, a physical movement value and/or an exercise intensity according to an exercise mode, or using a lookup table in which an (additional) exercise amount achievement estimate may be defined according to a physical movement value of the user and an exercise intensity, but examples are not limited thereto.

In an example embodiment, the electronic device 210 may evaluate the number of times of performing an exercise motion of the user and a posture accuracy of the user, based on the received sensor data.

In operation 870, the electronic device 210 may output a GUI in which an exercise activity indicator is displayed. The exercise activity indicator may include one or more graphic indicators for indicating the estimated exercise amount. The one or more graphic indicators may include a first graphic element corresponding to a target exercise amount to be achieved by the user through the exercise, a second graphic element corresponding to an exercise amount achievement estimate that is achieved when the user performs the exercise without applying the selected exercise intensity, and a third graphic element corresponding to an additional exercise amount achievement estimate that is achieved when the user performs the exercise by applying the selected exercise intensity. In an example embodiment, when the exercise activity indicator is output through the GUI, the first graphic element and the second graphic element may be displayed as overlaid with each other, and the first graphic element and the third graphic element may be displayed as overlaid with each other. The third graphic element may be displayed as starting from an end point of the second graphic element.

In operation 875, the electronic device 210 may determine whether the exercise of the user has ended. In an example embodiment, the electronic device 210 may determine that the exercise of the user has ended in at least one of cases, for example, when the movement value of the sensor data indicates a movement value corresponding to the end of the exercise, when a predefined period of time has elapsed, when a command for ending the exercise assistance mode is received through a user input, or when a predefined number of times of performing an exercise motion has reached.

When it is determined that the exercise of the user has not ended ("No" in operation 875), the electronic device 210 may perform the operations again starting from operation 860. The electronic device 210 may analyze an exercise amount of the user based on the sensor data received from the wearable device 100 and provide analyzed exercise amount information to the user through the GUI.

In operation 880, when it is determined that the exercise of the user has ended ("Yes" in operation 875), the electronic device 210 may determine exercise result information according to the entire exercise of the user and output the determined exercise result information through the GUI. The exercise result information may include information about, for example, a total calorie consumption estimate which indicates total calories consumed by the exercise of the user, an exercise amount estimate that is achieved for each exercise type (e.g., a muscle strengthening exercise, a balance exercise, and an aerobic exercise), an exercise performance time, and a target exercise amount achievement index.

In operation 885, when the user fails to achieve the given target exercise amount, the electronic device 210 may determine a recommended exercise program for the user to achieve the target exercise amount that has not been achieved and provide the determined recommended exercise program to the user through the GUI. The electronic device 210 may output a list of a plurality of determined recommended exercise programs. For example, the electronic device 210 may provide a recommended exercise program in which several exercise programs are combined. When the user achieves the given target exercise amount, operation 855 may not be performed.

Figure 9:
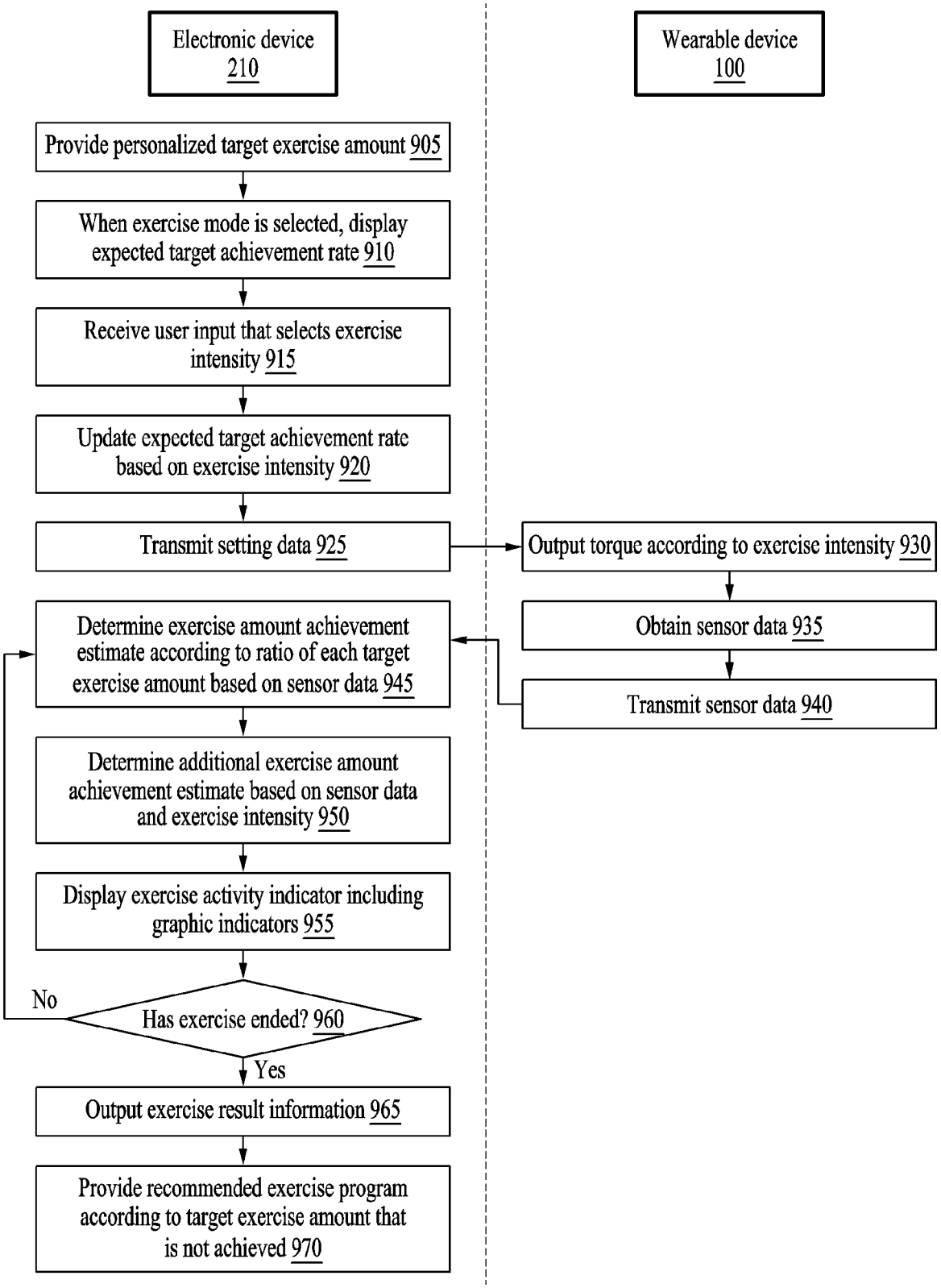
FIG. 9 is a flowchart illustrating an example of a method of providing exercise amount measurement information in an exercise assistance mode according to an example embodiment.

FIG. 9 is a flowchart illustrating an example of a method of providing exercise amount measurement information in an exercise assistance mode according to an example embodiment. In an example embodiment, at least one of operations to be described below with reference to FIG. 9 may be performed simultaneously or in parallel with another operation, and the order of the operations may be changed. In addition, at least one of the operations may be omitted, or another operation may be added.

Referring to FIG. 9, in operation 905, the electronic device 210 may provide a personalized target exercise amount through a GUI. For example, the electronic device 210 may provide a total exercise amount to be achieved by a user within a predetermined period of time (e.g., a day, a week, or a month), with a target exercise amount ratio being distinguished by each exercise type (e.g., a muscle strengthening exercise, a balance exercise, or an aerobic exercise). The target exercise amount ratio may be provided by graphic indicators output through the GUI.

In operation 910, when the user selects a specific exercise mode (e.g., lunge, reverse lunge, squat, half squat, stretching, running, or walking), the electronic device 210 may display an expected target achievement rate through the GUI. The electronic device 210 may determine the expected target achievement rate which is a rate of an exercise amount to be achieved by the user performing the exercise mode selected by the user with respect to a total exercise amount indicated by the personalized target exercise amount. The electronic device 210 may provide, as the graphic indicators, the target exercise amount ratio between respective exercise types (e.g., the muscle strengthening exercise, the balance exercise, and the aerobic exercise) in the exercise mode selected by the user.

In operation 915, the electronic device 210 may receive a user input that selects an exercise intensity to be applied to the exercise mode selected by the user. Based on the exercise intensity, a characteristic (e.g., a resistance force or an assistance force) and an intensity (e.g., a maximum intensity) of torque generated by the wearable device 100 may be determined.

In operation 920, the electronic device 210 may update the expected target achievement rate based on the exercise intensity selected by the user and display the updated expected target achievement rate. For example, in a case in which a basic exercise intensity is set and a calorie consumption estimate is accordingly indicated as 30 kilocalories per minute (Kcal/min), when the exercise intensity increases from the basic exercise intensity according to what the user selects, the calorie consumption estimate may be updated to and indicated as 62 Kcal/min. The user may thus effectively recognize the influence of the magnitude of the exercise intensity selected by the user on the achievement of the exercise amount.

In operation 925, the electronic device 210 may transmit setting data on the exercise intensity selected by the user input to the wearable device 100. The wearable device 100 may receive, from the electronic device 210, the setting data and a control command for operating in an exercise assistance mode.

In operation 930, the wearable device 100 may start operating in the exercise assistance mode and output torque according to the exercise intensity indicated in the setting data during the exercise of the user through a driving module comprising driving circuitry. When the exercise intensity is set to be high, a resistance force that hinders a movement of the user by the wearable device 100 during the exercise may increase. According to an example embodiment, the user may select an exercise intensity corresponding to the provision of an assistance force. In this case, the wearable device 100 may output the assistance force for assisting the user with the movement during the exercise.

In operation 935, the wearable device 100 may obtain sensor data including a physical movement value of the user through a sensor module (comprising a sensor) during the exercise of the user. In operation 940, the wearable device 100 may transmit the obtained sensor data to the electronic device 210.

In operation 945, the electronic device 210 may determine an exercise amount achievement estimate according to a ratio between respective target exercise amounts based on the sensor data received from the wearable device 100. Based on the sensor data, the electronic device 210 may determine an exercise amount achievement estimate for each exercise type in the exercise mode selected by the user. The exercise amount achievement estimate, which is a value calculated when the selected exercise intensity is not applied, may correspond to an exercise amount achievement estimate achieved by the user doing the exercise with only their body without the torque provided by the wearable device 100.

In operation 950, the electronic device 210 may determine an additional exercise amount achievement estimate based on the sensor data and the exercise intensity selected by the user. The electronic device 210 may determine the additional exercise amount achievement estimate for each exercise type in the exercise mode selected by the user.

In operation 955, the electronic device 210 may display, through a GUI, an exercise activity indicator including graphic indicators indicating the determined exercise amount achievement estimate and the determined additional exercise amount achievement estimate. The exercise activity indicator may include the graphic indicators corresponding to exercise types (e.g., the muscle strengthening exercise, the balance exercise, and the aerobic exercise), and the graphic indicators may each include a first graphic element corresponding to a target exercise amount to be achieved by the user, a second graphic element corresponding to an exercise amount achievement estimate that is achieved when the user does the exercise without applying the selected exercise intensity, and a third graphic element corresponding to an additional exercise amount achievement estimate that is achieved when the user does the exercise by applying the selected exercise intensity.

In operation 960, the electronic device 210 may determine whether the exercise by the user has ended. When it is determined that the exercise has not ended ("No" in operation 960), the electronic device 210 may perform the operations again starting from operation 945.

In operation 965, when it is determined that the exercise has ended ("Yes" in operation 960), the electronic device 210 may evaluate the exercise amount in the exercise mode performed by the user based on the sensor data and determine exercise result information, and output the determined exercise result information through the GUI. In operation 970, when the user fails to achieve the given target exercise amount as the result of evaluating the exercise amount, the electronic device 210 may provide the user with a recommended exercise program according to the target exercise amount that has not been achieved by the user. For example, as the result of evaluating the exercise amount, when it is evaluated that the user has not achieved relatively much of a target muscle strengthening exercise amount, the electronic device 210 may select an exercise program or a combination of exercise programs that may enable the user to achieve the target muscle strengthening exercise amount that has not been achieved.

Figure 10:
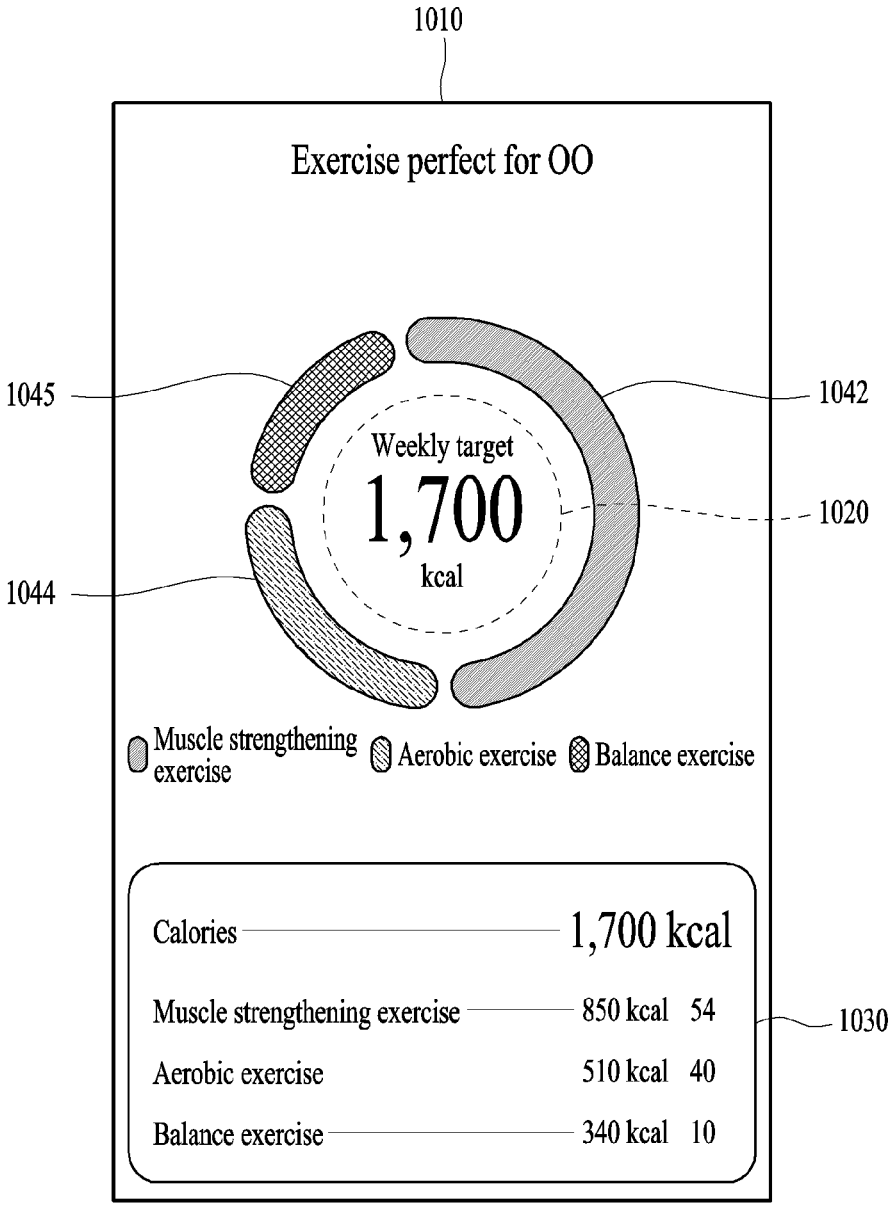
FIG. 10 is a diagram illustrating an example screen of a graphical user interface (GUI) providing a personalized target exercise amount according to an example embodiment.

FIG. 10 is a diagram illustrating an example screen of a GUI providing a personalized target exercise amount according to an example embodiment.

Referring to FIG. 10, one screen 1010 of a GUI provided by the electronic device 210 may provide a personalized target exercise amount of a user. In an example embodiment, the screen 1010 displaying the personalized target exercise amount may include an indicator 1020 indicating a total target exercise amount to be achieved by the user within a predetermined period of time, and graphic indicators 1042, 1044, and 1045 indicating a target exercise amount ratio between respective exercise types (e.g., a muscle strengthening exercise, an aerobic exercise, and a balance exercise). The total target exercise amount to be achieved within the predetermined period of time may indicate, for example, a target calorie amount required to be consumed by the user on a weekly basis, and the electronic device 210 may distribute a target exercise amount to each of the muscle strengthening exercise, the aerobic exercise, and the balance exercise based on the target calorie amount.

In an example embodiment, the screen 1010 may display the graphic indicator 1042 indicating a target exercise amount ratio of the muscle strengthening exercise, the graphic indicator 1044 indicating a target exercise amount ratio of the aerobic exercise, and the graphic indicator 1045 indicating a target exercise amount ratio of the balance exercise. The graphic indicator 1042 may indicate a ratio of the target exercise amount of the muscle strengthening exercise to the total target exercise amount. The graphic indicator 1044 may indicate a ratio of the target exercise amount of the aerobic exercise to the total target exercise amount. The graphic indicator 1045 may indicate a ratio of the target exercise amount of the balance exercise to the total exercise amount.

In an example embodiment, each of the graphic indicators 1042, 1044, and 1045 may be displayed in the form of an arc as shown. The graphic indicators 1042, 1044, and 1045 may be displayed as adjacent to each other, and each arc length may be flexibly changed within a circular shape according to the ratio of the target exercise amount of each exercise type. However, the displayed form of the graphic indicators 1042, 1044, and 1045 is not limited to the illustrated form. For example, the graphic indicators 1042, 1044, and 1045 may also be displayed in the form of a bar graph or a slanted bar graph. The screen 1010 may further include an area 1030 displaying specific numerical values of the target exercise amounts for the respective exercise types.

For each user, a target exercise amount and/or a target exercise amount ratio between exercise types may be different. The electronic device 210 may determine a target exercise amount of a user based on physical information (e.g., height, age, and weight) input by the user, or determine a target exercise amount of a user based on a physical ability of the user measured as a physical ability measurement mode of the wearable device 100 progresses.

In an example embodiment, the electronic device 210 may adjust the personalized target exercise amount by a specific time unit and provide the user with the adjusted personalized target exercise amount. For example, the electronic device 210 may divide a target calorie consumption to be achieved by the user for a week by a daily unit for each exercise type and provide the user with the divided target calorie consumption.

Figure 11A:
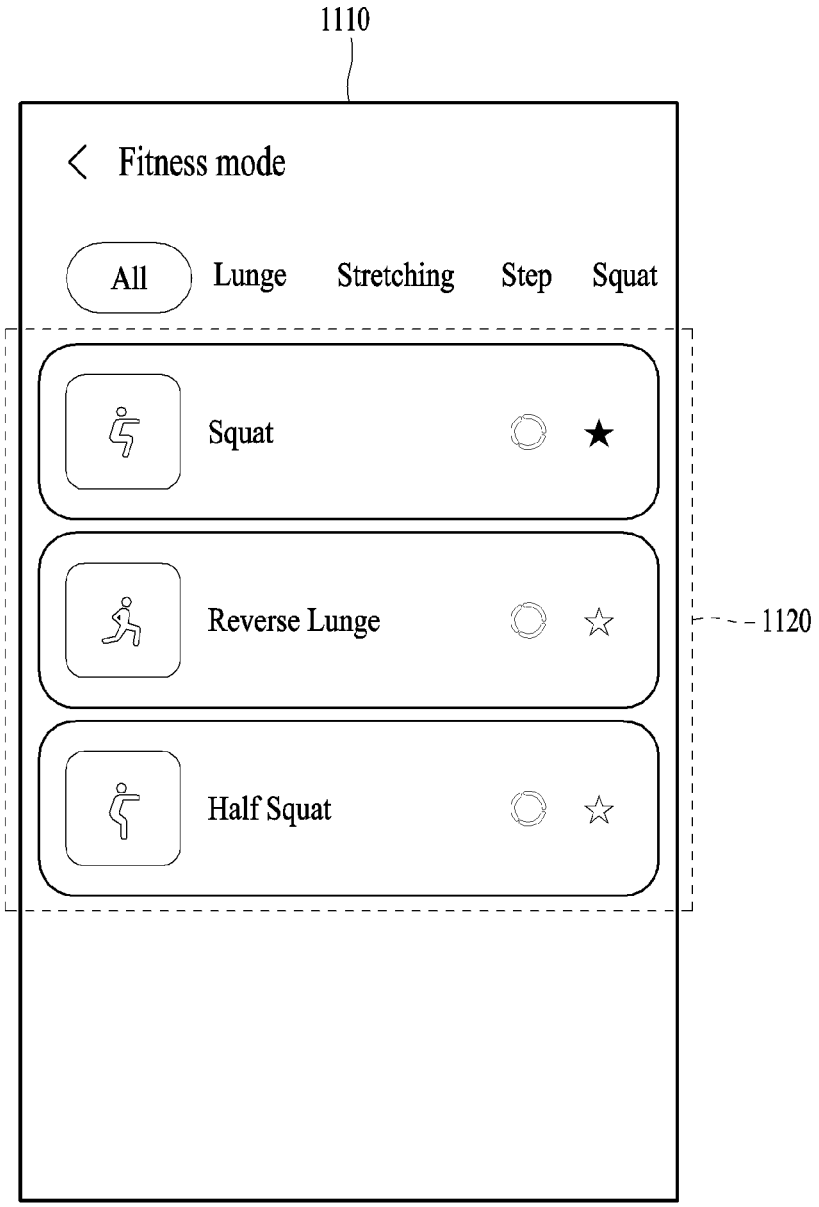
FIGS. 11A and 11B are diagrams illustrating example screens of a GUI recommending an exercise mode to a user according to an example embodiment.
Figure 11B:
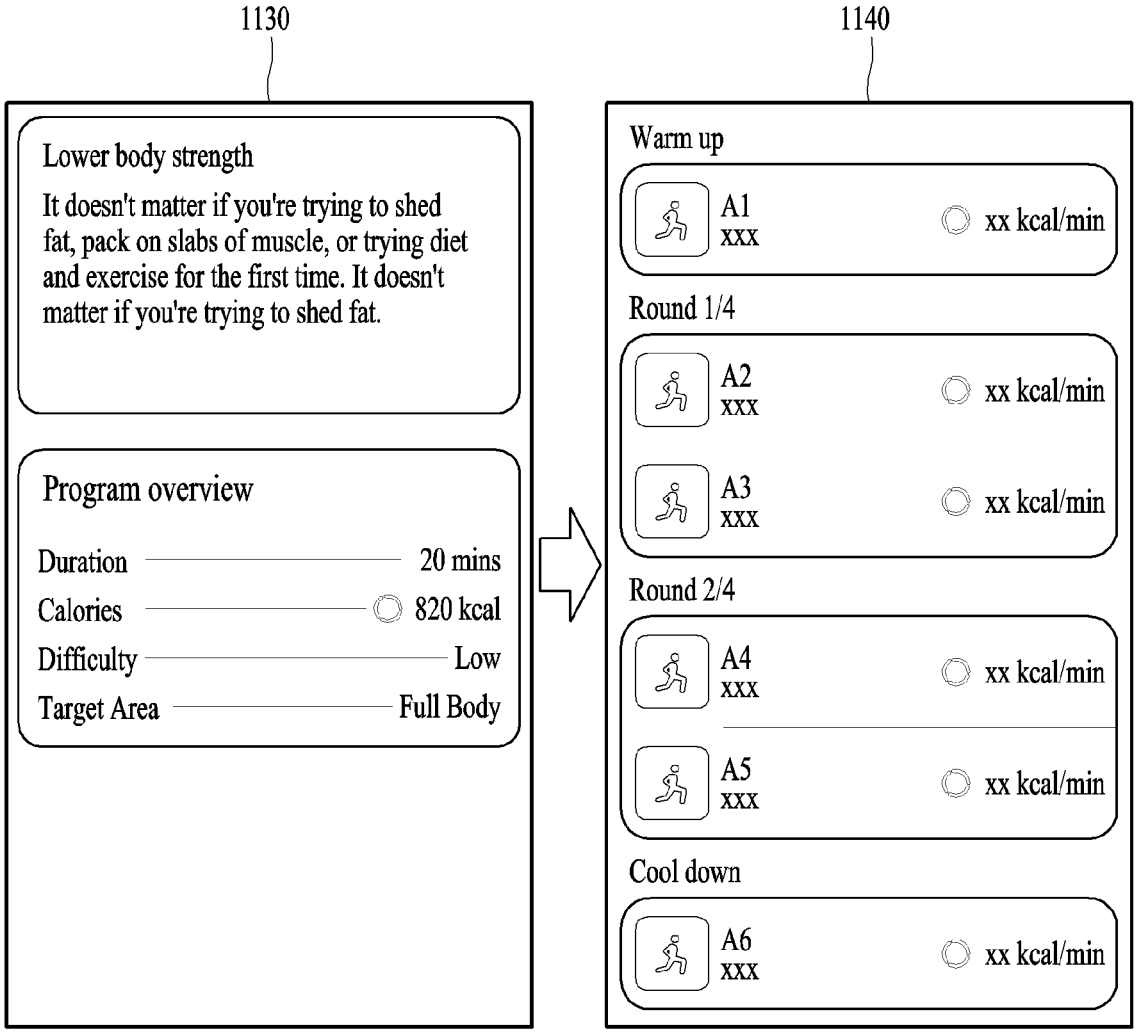

FIGS. 11A and 11B are diagrams illustrating example screens of a GUI recommending an exercise mode to a user according to an example embodiment.

According to an example embodiment, referring to FIG. 11A, the electronic device 210 may recommend an exercise mode (or an exercise program) suitable for a physical characteristic of a user. As shown on a screen 1110 of a GUI, the electronic device 210 may provide the user with a list 1120 of exercise modes with which the user may be able to efficiently achieve a personalized target exercise amount provided to the user.

For example, when a user A has a physical characteristic with a relatively good balance ability yet a relatively poor muscular ability, the electronic device 210 may provide the user A with a personalized target exercise amount that focuses on a muscle strengthening exercise. In this example, the electronic device 210 may provide the user A with a list of exercise modes having a relatively low ratio of a balance exercise amount and a relatively high ratio of a muscle strengthening exercise amount to enable the user A to efficiently achieve the personalized target exercise amount. The list 1120 may provide a graphic element in which an exercise amount ratio between respective exercise types (e.g., the muscle strengthening exercise, the aerobic exercise, and the balance exercise) for each exercise mode is identifiable.

For another example, when a user B has a physical characteristic with a relatively good muscular strength yet a relatively poor balance ability, the electronic device 210 may provide the user B with a personalized target exercise amount that focuses on the balance exercise. In this example, the electronic device 210 may provide the user B with a list of exercise modes having a relatively low ratio of a muscle strengthening exercise amount and a relatively high ratio of a balance exercise amount to enable the user B to efficiently achieve the personalized target exercise amount.

Referring to FIG. 11B, the electronic device 210 may recommend an exercise program including a combination of a plurality of exercise modes to a user through a GUI. A screen 1130 of the GUI may provide information about an overview of the exercise program. The information may include information about, for example, a total exercise time, an expected calorie consumption, an exercise difficulty level, and a body part to which an exercise effect is to be applied, which relates to the exercise program. In an example embodiment, the electronic device 210 may determine the information about the overview of the exercise program based on an exercise time of each of exercise modes included in the exercise program, an exercise difficulty of each exercise mode, and a sum or average of exercise amount ratios of respective exercise types.

In an example embodiment, the exercise program may include a warm-up step, a round step, and a cool-down step for each exercise interval, and one or more exercise modes performed for each step may be defined. As shown on a screen 1140 of the GUI, the electronic device 210 may provide information about an exercise mode included in each step of the exercise program.

In an example embodiment, when the user scrolls down a screen or selects a graphic object for executing a connection to the screen 1140, while the screen 1130 is output, the screen 1140 may be output.

Figure 12A:
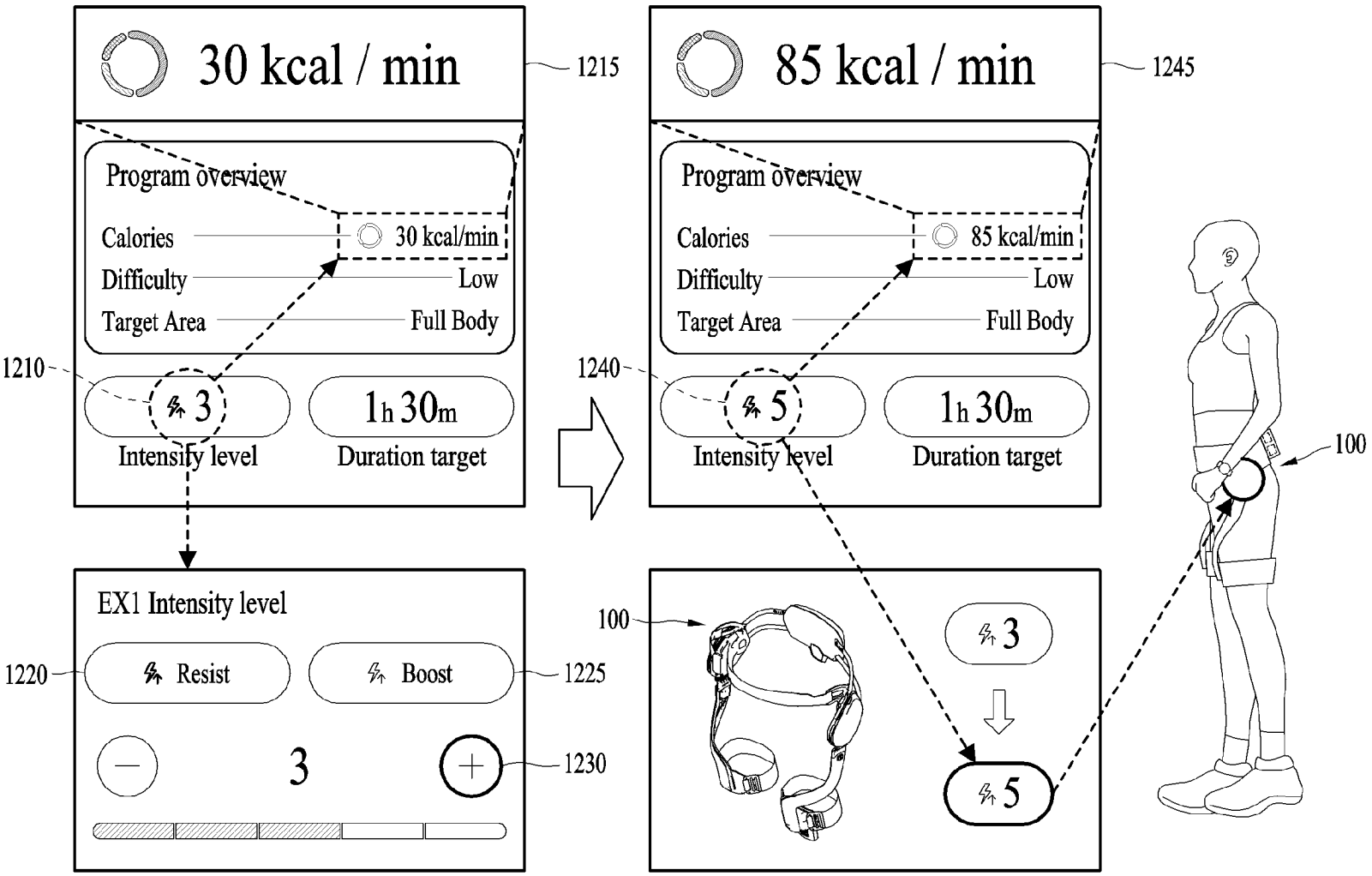
FIGS. 12A and 12B are diagrams illustrating an example screen of a GUI for a user to select an exercise intensity and an example screen of a GUI displaying a change in a calorie consumption estimate based on a selected exercise intensity according to an example embodiment.
Figure 12B:
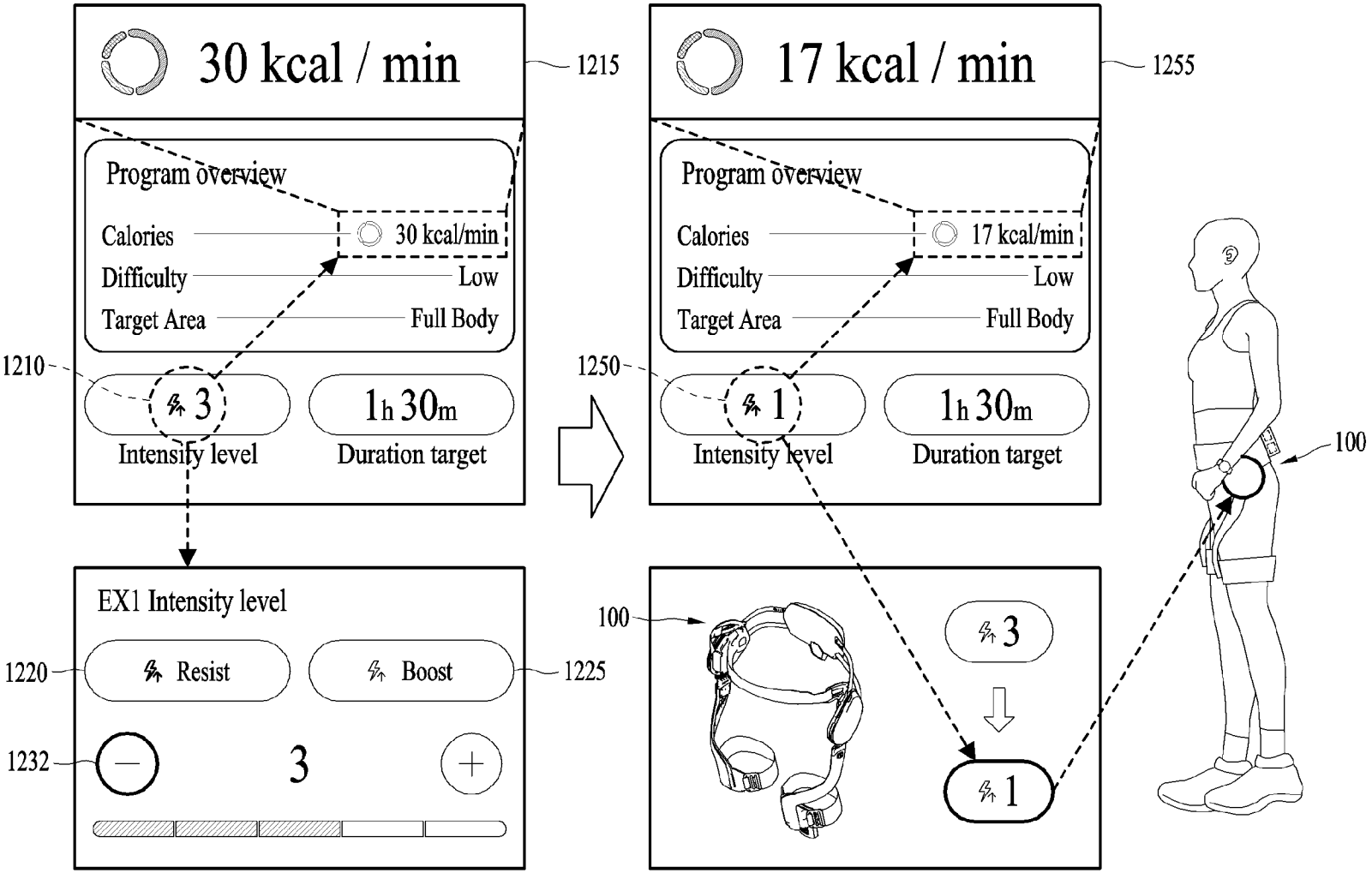

FIGS. 12A and 12B are diagrams illustrating an example screen of a GUI for a user to select an exercise intensity and an example screen of a GUI displaying a change in a calorie consumption estimate based on a selected exercise intensity according to an example embodiment.

A user may easily select an exercise intensity to be applied to an exercise mode they attempt to perform through a GUI. The user may unrestrictedly adjust the exercise intensity according to their physical conditions through the GUI. In an example embodiment, as the user controls a graphic element displayed on a screen of the GUI for detailed settings of a selected exercise mode, the user may also determine whether to receive a resistance force or an assistance force through the wearable device 100 during an exercise to be performed by the user and determine an intensity of the resistance force or the assistance force. Based on the exercise intensity selected by the user, the electronic device 210 may estimate a calorie consumption estimate which is an expected exercise target achievement rate, and may provide the calorie consumption estimate to the user through the GUI.

FIG. 12A is a diagram illustrating an example case in which a user increases an exercise intensity according to an example embodiment. A screen of a GUI may display a reference exercise intensity 1210 set for an exercise mode selected by the user and a calorie consumption estimate 1215 according to the reference exercise intensity 1210. The electronic device 210 may determine the calorie consumption estimate 1215 based on an exercise effect DB defined based on an exercise mode and an exercise intensity.

The user may select a graphic object 1220 of the GUI to set the wearable device 100 to provide a resistance force during an exercise performed by the user and may adjust an intensity of the resistance force to be provided. The user may increase the intensity of the resistance force by pressing a graphic object 1230. As the intensity of the resistance force increases, the exercise intensity may also increase. The user may set a desired exercise intensity by pressing the graphic object 1230 several times or continuously pressing the graphic object 1230. When the user selects a graphic object 1225 of the GUI, the user may set the wearable device 100 to provide an assistance force during the exercise performed by the user and adjust an intensity of the assistance force to be provided.

For example, when the user sets the exercise intensity from 3 to 5, a currently set exercise intensity 1240 may be displayed through the GUI, and a calorie consumption estimate 1245 updated according to the set exercise intensity 1240 may be provided through the GUI. In this example, as the set value of the exercise intensity increases, it may be verified that the calorie consumption estimate 1215 increases to the calorie consumption estimate 1245. The user may adjust the exercise intensity to be applied to the exercise mode before performing the exercise and may effectively recognize a change in an exercise target achievement rate by the adjustment of the exercise intensity.

In an example embodiment, setting data including information about the set exercise intensity 1240 may be transmitted to the wearable device 100, and the wearable device 100 may generate a resistance force corresponding to the exercise intensity 1240 set by the user during the exercise performed by the user. As the exercise intensity set by the user increases, an intensity of the resistance force to be provided by the wearable device 100 may increase.

FIG. 12B is a diagram illustrating an example case in which a user decreases an exercise intensity according to an example embodiment. A screen of a GUI may display a reference exercise intensity 1210 set for an exercise mode selected by the user and a calorie consumption estimate 1215 according to the reference exercise intensity 1210. The user may select a graphic object 1220 of the GUI to set the wearable device 100 to provide a resistance force during an exercise performed by the user and may adjust an intensity of the resistance force to be provided. The user may decrease the intensity of the resistance force by pressing a graphic object 1232. As the intensity of the resistance force decreases, the exercise intensity may also increase. The user may set a desired exercise intensity by pressing the graphic object 1232 several times or continuously pressing the graphic object 1232.

For example, when the user sets the exercise intensity from 3 to 1, a currently set exercise intensity 1250 may be displayed through the GUI, and a calorie consumption estimate 1255 updated according to the set exercise intensity 1250 may be provided through the GUI. In this example, as the set value of the exercise intensity decreases, it may be verified that the calorie consumption estimate 1215 decreases to the calorie consumption estimate 1255.

In an example embodiment, setting data including information about the set exercise intensity 1250 may be transmitted to the wearable device 100, and the wearable device 100 may generate a resistance force corresponding to the exercise intensity 1250 set by the user during the exercise performed by the user. As the exercise intensity set by the user decreases, an intensity of the resistance force to be provided by the wearable device 100 may decrease.

Figure 13:
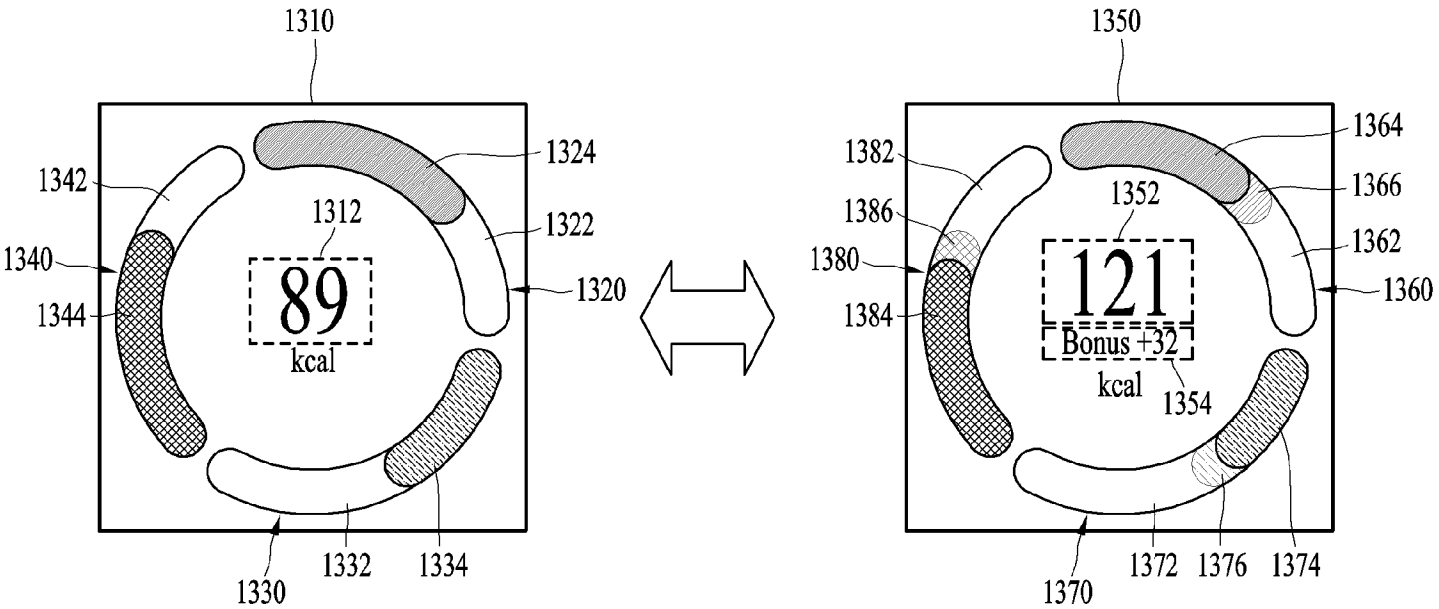
FIG. 13 is a diagram illustrating an example screen of a GUI displaying an exercise activity indicator including a plurality of graphic indicators according to an example embodiment.

FIG. 13 is a diagram illustrating an example screen of a GUI displaying an exercise activity indicator including a plurality of graphic indicators according to an example embodiment.

According to an example embodiment, referring to FIG. 13, an exercise activity indicator 1310 provided on a screen of a GUI may be an exercise activity indicator indicated when there is no additional exercise amount achievement estimate because there is no resistance force generated by the wearable device 100. For example, when a user sets an exercise intensity to "0," no resistance force may be generated by the wearable device 100. The exercise activity indicator 1310 may indicate a total exercise amount estimate 1312 (e.g., a calorie consumption estimate) that is currently achieved.

In an example embodiment, the exercise activity indicator 1310 may include one or more graphic indicators for indicating an exercise amount estimated during an exercise performed by the user. The exercise activity indicator 1310 may include, for example, a graphic indicator 1320 corresponding to a muscle strengthening exercise amount achieved during the exercise by the user, a graphic indicator 1330 corresponding to an aerobic exercise amount achieved during the exercise, and a graphic indicator 1340 corresponding to a balance exercise amount achieved during the exercise, for each exercise type.

The graphic indicator 1320 may include a first graphic element 1322 corresponding to a target muscle strengthening exercise amount to be achieved by the user and a second graphic element 1324 corresponding to a muscle strengthening exercise amount achievement estimate that is achieved when the user does the exercise without applying the exercise intensity. The graphic indicator 1330 may include a first graphic element 1332 corresponding to a target aerobic exercise amount to be achieved by the user and a second graphic element 1334 corresponding to an aerobic exercise amount achievement estimate that is achieved when the user does the exercise without applying the exercise intensity. The graphic indicator 1340 may include a first graphic element 1342 corresponding to a target balance exercise amount to be achieved by the user and a second graphic element 1344 corresponding to a balance exercise amount achievement estimate that is achieved when the user does the exercise without applying the exercise intensity.

When the wearable device 100 applies a resistance force to the exercise performed by the user as the user selects the exercise intensity, the electronic device 210 may separately calculate an additional exercise amount achievement estimate according to the exercise intensity, and display the calculated additional exercise amount achievement estimate through graphic indicators for each exercise type. An exercise activity indicator 1350 may be an exercise activity indicator indicated when there is an additional exercise amount achievement estimate because there is a resistance force generated by the wearable device 100. The exercise activity indicator 1350 may indicate an additional exercise amount achievement estimate 1354 according to the selected exercise intensity, along with a total exercise amount estimate 1352 (e.g., a calorie consumption estimate) achieved by a current point in time. The total exercise amount estimate 1352 may be a sum of an exercise amount achievement estimate (e.g., the exercise amount estimate 1312) achieved without the application of the exercise intensity and the additional exercise amount achievement estimate 1354 achieved according to the selected exercise intensity.

In an example embodiment, the exercise activity indicator 1350 may include a graphic indicator 1360 corresponding to a muscle strengthening exercise amount achieved during the exercise performed by the user, a graphic indicator 1370 corresponding to an aerobic exercise amount achieved during the exercise, and a graphic indicator 1380 corresponding to a balance exercise amount achieved during the exercise process, for each exercise type.

The graphic indicator 1360 may include a first graphic element 1362 corresponding to a target muscle strengthening exercise amount to be achieved by the user, a second graphic element 1364 corresponding to a muscle strengthening exercise amount achievement estimate that is achieved when the user does the exercise without applying the exercise intensity, and a third graphic element 1366 corresponding to an additional muscle strengthening exercise amount achievement estimate that is achieved when the user does the exercise by applying the exercise intensity. The graphic indicator 1370 may include a first graphic element 1372 corresponding to a target aerobic exercise amount to be achieved by the user, a second graphic element 1374 corresponding to an aerobic exercise amount achievement estimate that is achieved when the user does the exercise without applying the exercise intensity, and a third graphic element 1376 corresponding to an additional aerobic exercise amount achievement estimate that is achieved when the user does the exercise by applying the exercise intensity. The graphic indicator 1380 may include a first graphic element 1382 corresponding to a target balance exercise amount to be achieved by the user, a second graphic element 1384 corresponding to a balance exercise amount achievement estimate that is achieved when the user does the exercise without applying the exercise intensity, and a third graphic element 1386 corresponding to an additional balance exercise amount achievement estimate that is achieved when the user does the exercise by applying the exercise intensity.

When the wearable device 100 generates a resistance force according to what is set for the wearable device 100 during the exercise performed by the user, the electronic device 210 may calculate an additional exercise amount achievement estimate according to the exercise intensity selected by the user based on sensor data received from the wearable device 100 and the exercise intensity selected by the user, and display the calculated additional exercise amount achievement estimate by the third graphic elements 1366, 1376, and 1386 for each exercise type. In this way, the additional exercise amount achievement estimate that is generated by the exercise assistance by the wearable device 100 may be visually displayed.

In an example embodiment, when the user touches an area in which any one of the third graphic elements 1366, 1376, and 1386 is output on a screen of the electronic device 210 or when the user touches an area in which the additional exercise amount achievement estimate 1354 is displayed on the screen of the electronic device 210, a screen of the GUI for adjusting the exercise intensity may be provided to the user.

Figure 14:
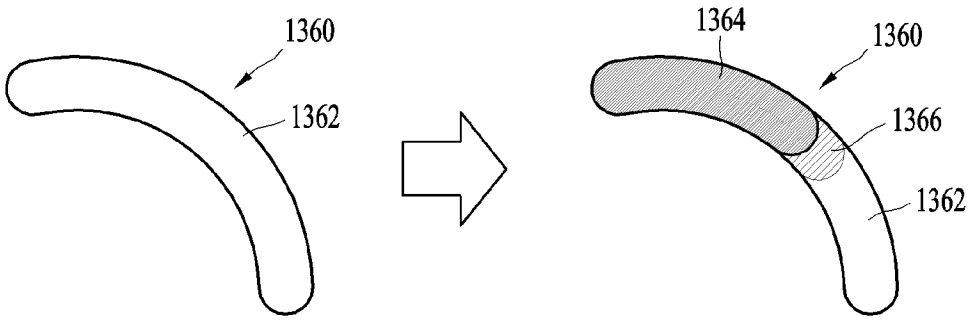
FIG. 14 is a diagram illustrating an example of a representation of a graphic indicator according to an example embodiment.

FIG. 14 is a diagram illustrating an example of a representation of a graphic indicator according to an example embodiment.

Referring to FIG. 14, a graphic indicator 1360 corresponding to a muscle strengthening exercise amount is illustrated as an example of a graphic indicator. In an example embodiment, the length of the graphic indicator 1360 may vary according to an exercise intensity selected by a user.

Before the user starts doing an exercise, only a first graphic element 1362 corresponding to a target muscle strengthening exercise amount to be achieved by the user may be displayed on the graphic indicator 1360.

When the user starts doing the exercise, movement information of the user may be transmitted to the electronic device 210 as being included in sensor data. The electronic device 210 may analyze a muscle strengthening exercise amount of the user based on the sensor data and the exercise intensity selected by the user, and may display a result of analyzing the muscle strength strengthening exercise amount on the graphic indicator 1360. As the exercise progresses, a muscle strengthening exercise amount achievement estimate achieved by the user may start increasing gradually, and the muscle strengthening exercise amount achievement estimate may be displayed by a second graphic element 1364 on the graphic indicator 1360. The first graphic element 1362 and the second graphic element 1364 may be displayed as being overlaid with each other. As the exercise progresses, the second graphic element 1364 may be displayed as gradually increasing, starting from one end of the first graphic element 1362. The second graphic element 1364 may be displayed in a form gradually filling up from one end of the first graphic element 1362.

As the exercise progresses, an additional muscle strengthening exercise amount achievement estimate according to the application of the exercise intensity may start increasing gradually, and the additional muscle strengthening exercise amount achievement estimate may be displayed by a third graphic element 1366 on the graphic indicator 1360. The third graphic element 1366 and the first graphic element 1362 may be displayed as being overlaid with each other. As the exercise progresses, the third graphic element 1366 may be displayed as increasing gradually, starting from one end (e.g., an end point) of the second graphic element 1364. The third graphic element 1366 may be displayed in a form gradually filling up from one end of the second graphic element 1364. A sum of the muscle strengthening exercise amount achievement estimate indicated by the second graphic element 1364 and the additional muscle strengthening exercise amount achievement estimate indicated by the third graphic element 1366 may correspond to a total muscle strengthening exercise amount achievement estimate that is achieved by a current point in time by the user performing the exercise.

In an example embodiment, the second graphic element 1364 may be displayed as being brighter than the first graphic element 1362, and the third graphic element 1366 may be displayed as being brighter than the second graphic element 1364. However, examples are not limited thereto. At least two of the first graphic element 1362, the second graphic element 1364, and/or the third graphic element 1366 may be displayed in different colors and/or textures.

A method of displaying the graphic indicator 1360 corresponding to a muscle strengthening exercise amount described above may also be applied to a method of displaying the graphic indicator 1370 corresponding to an aerobic exercise amount and the graphic indicator 1380 corresponding to a balance exercise amount.

Figure 15C:
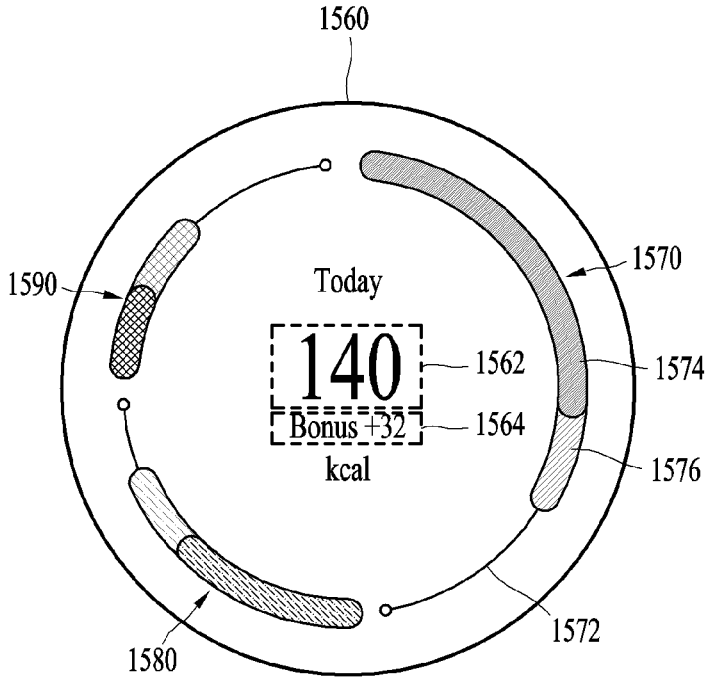

FIGS. 15A, 15B, and 15C are diagrams illustrating various examples of an exercise activity indicator according to an example embodiment.

According to an example embodiment, referring to FIG. 15A, each of graphic indicators 1522, 1524, and 1526 in an exercise activity indicator 1510 may be displayed in the form of an arc. The graphic indicators 1522, 1524, and 1526 may each indicate a target exercise amount ratio of each exercise type and an exercise amount achievement degree according to the performance of an exercise by a user. The graphic indicators 1522, 1524, and 1526 may be displayed as adjacent to each other, and may each have a length within a circular shape that is determined based on a ratio of a target exercise amount of each exercise type to a total target exercise amount. For example, respective lengths of the graphic indicators 1522, 1524, and 1526 may be determined based on a ratio of a target muscle strengthening exercise amount, a target aerobic exercise amount, and a target balance exercise amount, respectively. The exercise activity indicator 1510 may indicate an additional exercise amount achievement estimate 1514 according to an exercise intensity selected by the user, along with a total exercise amount estimate 1512 (e.g., a calorie consumption estimate) achieved by the user by a current point time.

According to an example embodiment, referring to FIG. 15B, each of graphic indicators 1540, 1550, and 1555 in an exercise activity indicator 1530 may be displayed in the form of a bar graph or a slanted bar graph. In an example embodiment, respective lengths of the graphic indicators 1540, 1550, and 1555 may be determined based on the magnitude of a target muscle strengthening exercise amount, a target aerobic exercise amount, and a target balance exercise amount. Each of the graphic indicators 1540, 1550, and 1555 may include a first graphic element, a second graphic element, and a third graphic element. For example, in the graphic indicator 1540, a first graphic element 1542 and a second graphic element 1544 may be displayed as being overlaid, and a third graphic element 1546 and the first graphic element 1542 may also be displayed as being overlaid. As the exercise performed by the user progresses, the second graphic element 1544 may be displayed as increasing gradually, starting from one end of the first graphic element 1542. As the exercise performed by the user progresses, the third graphic element 1546 may be displayed as increasing gradually, starting from one end (e.g., an end point) of the second graphic element 1544. The exercise activity indicator 1530 may indicate a total exercise amount estimate 1532 (e.g., a calorie consumption estimate) achieved by the user by a current point in time and an additional exercise amount achievement estimate 1534 according to an exercise intensity selected by the user.

According to an example embodiment, referring to FIG. 15C, each of graphic indicators 1570, 1580, and 1590 in an exercise activity indicator 1560 may be displayed in the form of an arc, similar to what is shown in FIG. 15A. Each of the graphic indicators 1570, 1580, and 1590 may include a first graphic element, a second graphic element, and a third graphic element. However, dissimilar to what is shown in FIG. 15A, at least two of the first graphic element, the second graphic element, and the third graphic element in each of the graphic indicators 1570, 1580, and 1590 may be indicated in different thicknesses. For example, in the graphic indicator 1570, the thicknesses of a first graphic element/indicator 1572 and the thickness of a second graphic element/indicator 1574 may be displayed differently. The second graphic element 1574 and/or a third graphic element/indicator 1576 may be displayed as thicker than the first graphic element 1572. In this way, feedback on the achievement of a target exercise amount may be more effectively provided to the user, which may increase the user's intent to achieve the target exercise amount. The exercise activity indicator may indicate a total exercise amount estimate 1562 (e.g., a calorie consumption estimate) achieved by the user by a current point in time and an additional exercise amount achievement estimate 1564 according to an exercise intensity selected by the user.

Figure 16:
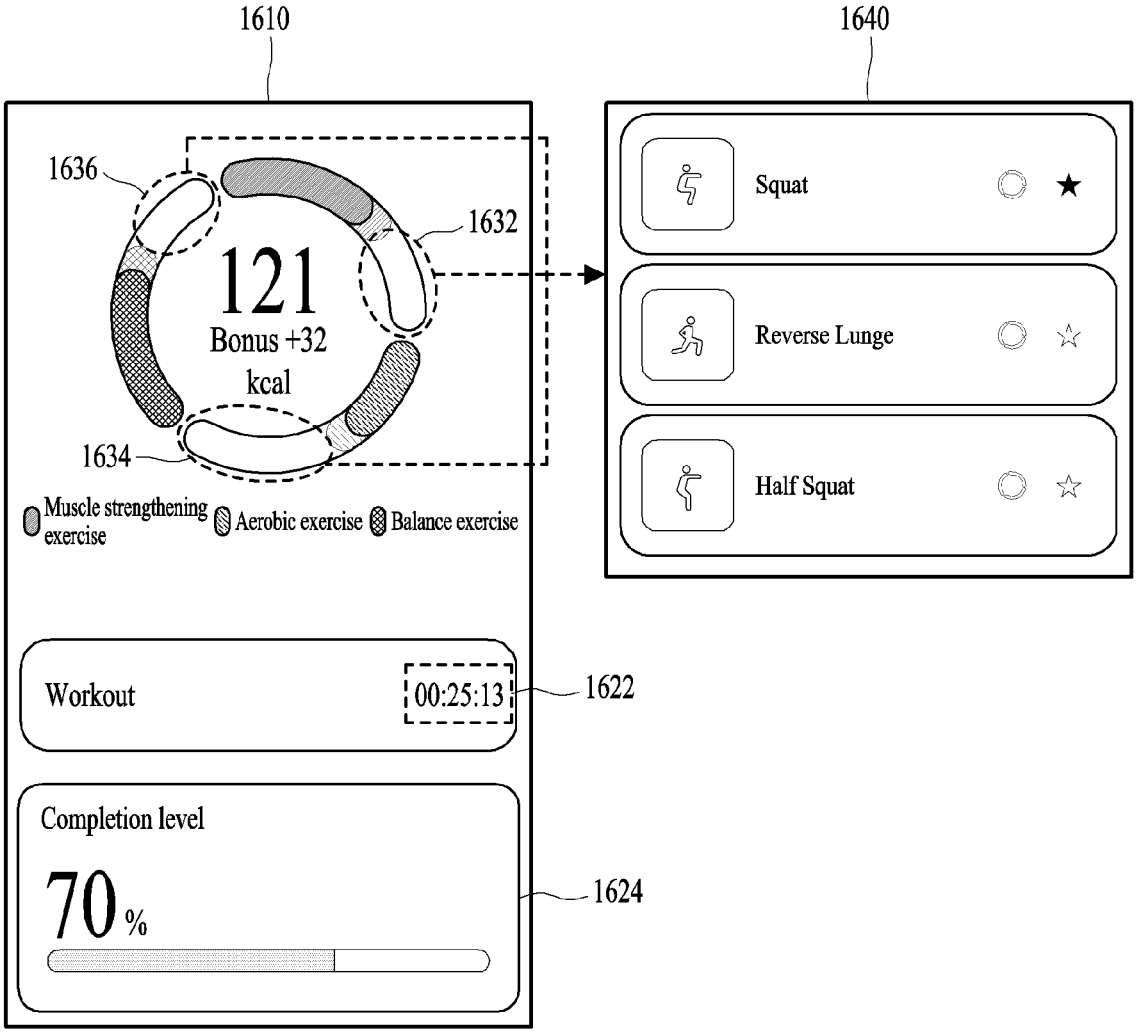
FIG. 16 is a diagram illustrating an example screen of a GUI displaying exercise result information and recommended exercise programs according to an example embodiment.

FIG. 16 is a diagram illustrating an example screen of a GUI displaying exercise result information and recommended exercise programs according to an example embodiment.

Referring to FIG. 16, a screen 1610 may display exercise result information provided through a GUI after an exercise performed by a user ends. The exercise result information displayed on the screen 1610 may include, for example, information about a total calorie consumption estimate which indicates calories consumed by the exercise, an exercise amount estimate which is achieved by each exercise type (e.g., a muscle strengthening exercise, a balance exercise, and an aerobic exercise), an exercise performance time 1622, and a target exercise amount achievement index 1624.

In an example embodiment, when an exercise amount achieved by the user performing the exercise is less than a target exercise amount provided to the user before the user starts doing the exercise, an exercise amount that is not filled in each graphic indicator may be displayed as unfilled by a second graphic element and a third graphic element.

When the exercise amount achieved by the user performing the exercise is less than the target exercise amount, the electronic device 210 may determine one or more recommended exercise programs (or recommended exercise modes) for the user. The electronic device 210 may select the recommended exercise programs based on a total exercise amount required to be additionally achieved by the user and on a remaining exercise amount for each exercise type. For example, the electronic device 210 may determine the recommended exercise programs based on a remaining exercise amount 1632 that is not yet filled up to a target muscle strengthening exercise amount, a remaining exercise amount 1634 that is not yet filled up to a target aerobic exercise amount, and a remaining exercise amount 1636 that is not yet filled up to a target balance exercise amount. The electronic device 210 may select an exercise program that may satisfy the remaining exercise amounts 1632, 1634, and 1636 for the respective exercise types from a DB in which various exercise programs are stored and may recommend the selected exercise program to the user. The electronic device 210 may output a list 1640 of the determined recommended exercise programs.

According to an example embodiment, providing an optimal exercise goal suitable for each user based on each exercise type (e.g., a muscle strengthening exercise, an aerobic exercise, and a balance exercise) may maximize or increase the effects of an exercise performed by a user. "Based on" as used herein covers based at least on.

According to an example embodiment, providing a user with an exercise result in which an exercise intensity selected by the user is reflected may provide the user with more significant exercise evaluation information, and recommending an exercise program to a user based on a remaining exercise amount by which a target exercise amount is not achieved yet by the user may assist each user in achieving an exercise goal more effectively.

It is to be understood that various embodiments of the disclosure and the terms used therein are not intended to limit the technological features set forth herein to particular embodiments and include various changes, equivalents, or replacements for a corresponding embodiment. In connection with the description of the drawings, like reference numerals may be used for similar or related components. It is to be understood that a singular form of a noun corresponding to an item may include one or more of the things unless the relevant context clearly indicates otherwise. As used herein, "A or B," "at least one of A and B," "at least one of A or B," "A, B, or C," "at least one of A, B, and C," and "at least one of A, B, or C," each of which may include any one of the items listed together in the corresponding one of the phrases, or all possible combinations thereof. Terms such as "first" or "second" may simply be used to distinguish the component from other components in question, and do not limit the components in other aspects (e.g., importance or order). It is to be understood that if an element (e.g., a first element) is referred to, with or without the term "operatively" or "communicatively," as "coupled with," "coupled to," "connected with," or "connected to" another element (e.g., a second element), it denotes that the element may be coupled with the other element directly (e.g., by wire), wirelessly, or via at least a third element(s).

As used in connection with certain example embodiments of the disclosure, the term "module" may include a unit implemented in hardware, software, or firmware, and may interchangeably be used with other terms, for example, "logic," "logic block," "part," or "circuitry." A module may be a single integral component, or a minimum unit or part thereof, adapted to perform one or more functions. For example, according to an example embodiment, the module may be implemented in the form of an application-specific integrated circuit (ASIC). Thus, each "module" herein may comprise circuitry.

Software may include a computer program, a piece of code, an instruction, or some combination thereof, to independently or collectively instruct or configure the processing device to operate as desired. Software and/or data may be embodied permanently or temporarily in any type of machine, component, physical or virtual equipment, computer storage medium or device, or in a propagated signal wave capable of providing instructions or data to or being interpreted by the processing device. The software also may be distributed over network-coupled computer systems so that the software is stored and executed in a distributed fashion. The software and data may be stored by one or more non-transitory computer-readable recording mediums (e.g., the memory 514). For example, a processor of a device or machine may invoke at least one of the one or more instructions stored in the storage medium and execute it. This allows the machine to be operated to perform at least one function according to the at least one instruction invoked. The one or more instructions may include code generated by a compiler or code executable by an interpreter. The machine-readable storage medium may be provided in the form of a non-transitory storage medium. Here, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to various embodiments, a method according to an example embodiment may be included and provided in a computer program product. The computer program product may be traded as a product between a seller and a buyer. The computer program product may be distributed in the form of a machine-readable storage medium (e.g., a compact disc read-only memory (CD-ROM)), or be distributed (e.g., downloaded or uploaded) online via an application store (e.g., PlayStore™) or between two user devices (e.g., smartphones) directly. If distributed online, at least part of the computer program product may be temporarily generated or at least temporarily stored in the machine-readable storage medium, such as a memory of the manufacturer's server, a server of the application store, or a relay server.

According to various example embodiments, each component (e.g., a module or a program) of the components described above may include a single entity or multiple entities, and some of the multiple entities may be separately disposed in different components. According to various embodiments, one or more of the above-described components or operations may be omitted, or one or more other components or operations may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

While the disclosure has been illustrated and described with reference to various embodiments, it will be understood that the various embodiments are intended to be illustrative, not limiting. It will further be understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. An electronic device, comprising:

a communication module, comprising communication circuitry, configured to receive from a wearable device sensor data comprising movement information during an exercise of a user of the wearable device;

an input module, comprising input circuitry, configured to receive a user input that selects an exercise intensity to be applied to the exercise of the user;

a processor, comprising processor circuitry, configured to estimate an exercise amount of the user based on the received sensor data and the selected exercise intensity, and generate an exercise activity indicator comprising at least one graphic indicator indicating the estimated exercise amount; and a display module, comprising a display, configured to output a graphical user interface (GUI) in which the exercise activity indicator is displayed, wherein the at least one graphic indicator comprises:

a first graphic indicator corresponding to a target exercise amount to be achieved by the user through the exercise;

a second graphic indicator corresponding to an exercise amount achievement estimate that is achieved by the user doing the exercise without the selected exercise intensity being applied; and a third graphic indicator corresponding to an additional exercise amount achievement estimate that is achieved by the user doing the exercise with the selected exercise intensity being applied.

2. The electronic device of claim 1, wherein the processor is configured so that, in the GUI:

the first graphic indicator and the second graphic indicator are displayed as being overlaid, and the second graphic indicator is displayed as being gradually increased as the exercise of the user progresses.

3. The electronic device of claim 2, wherein, the processor is configured so that in the GUI:

the first graphic indicator and the third graphic indicator are displayed as being overlaid, and the third graphic indicator is displayed as being adjacent to the second graphic indicator.

4. The electronic device of claim 3, wherein, the processor is configured so that in the GUI:

the third graphic indicator is displayed as starting from an end point of the second graphic indicator.

5. The electronic device of claim 1, wherein the processor is configured to:

estimate the additional exercise amount achievement estimate based on the received sensor data and the selected exercise intensity.

6. The electronic device of claim 1, wherein, the processor is configured so that in the GUI:

the second graphic indicator is displayed as being brighter than the first graphic indicator, the third graphic indicator is displayed as being brighter than the second graphic indicator, and at least two of the first graphic indicator, the second graphic indicator, and the third graphic indicator are displayed in different colors.

7. The electronic device of claim 1, wherein the processor is configured so that the exercise activity indicator comprises at least one of:

a graphic indicator corresponding to a muscle strengthening exercise amount achieved from the exercise;

a graphic indicator corresponding to an aerobic exercise amount achieved from the exercise; or a graphic indicator corresponding to a balance exercise amount achieved from the exercise.

8. The electronic device of claim 7, wherein a ratio among a target exercise amount for the muscle strengthening exercise amount, a target exercise amount for the aerobic exercise amount, and a target exercise amount for the balance exercise amount is determined by a type of the exercise to be performed by the user.

9. The electronic device of claim 8, wherein, the processor is configured so that in the GUI:

the at least one graphic indicator is displayed in the form of an arc.

10. The electronic device of claim 8, wherein the processor is configured so that a length of the at least one graphic indicator displayed in the GUI is determined based on the ratio among the target exercise amount for the muscle strengthening exercise amount, the target exercise amount for the aerobic exercise amount, and the target exercise amount for the balance exercise amount.

11. The electronic device of claim 8, wherein, the processor is configured so that in the GUI:

the at least one graphic indicator is displayed in the form of a bar graph or a slanted bar graph.

12. The electronic device of claim 8, wherein, the processor is configured so that in the GUI:

at least two of the first graphic indicator, the second graphic indicator, and the third graphic indicator are displayed in different thicknesses.

13. The electronic device of claim 1, wherein the processor is configured to:

estimate at least one of an additional exercise amount achievement estimate of the user according to the selected exercise intensity and/or a calorie consumption estimate according to the selected exercise intensity, based on an exercise mode selected by the user and the selected exercise intensity, wherein the display module is configured to:

output information about at least one of the additional exercise amount achievement estimate and/or the calorie consumption estimate.

14. The electronic device of claim 1, wherein the processor is configured to:

control the communication module to transmit, to the wearable device, setting data on the exercise intensity selected by the user input to allow the wearable device to generate a resistance force or an assistance force corresponding to the selected exercise intensity during the exercise of the user.

15. The electronic device of claim 1, wherein the processor is configured to:

when an exercise amount achieved by the user is less than the target exercise amount, determine at least one recommended exercise program for the user, wherein the display module is configured to:

output a list of the determined at least one recommended exercise program.

16. A wearable device for assisting a user in doing an exercise, comprising:

a driving module, comprising circuitry, configured to generate torque to be applied to a body of the user;

a support frame configured to support the body of the user when the wearable device is worn on the body of the user so that the generated torque can be applied to the body of the user;

a sensor module, comprising a sensor, configured to obtain sensor data comprising movement information of the user of the wearable device;

a communication module, comprising communication circuitry, configured to receive setting data on an exercise intensity selected by a user input from an electronic device, and transmit the sensor data to the electronic device; and a control module, comprising circuitry, configured to control the driving module based on the selected exercise intensity in the setting data, wherein the control module is configured to:

control the communication module to transmit the sensor data to the electronic device to allow the electronic device to estimate an exercise amount of the user based on the sensor data and the selected exercise intensity, generate an exercise activity indicator comprising at least one graphic indicator for indicating the estimated exercise amount, and output a graphical user interface (GUI) in which the exercise activity indicator is displayed; and wherein the at least one graphic indicator comprises:

a first graphic indicator corresponding to a target exercise amount to be achieved by the user through the exercise;

a second graphic indicator corresponding to an exercise amount achievement estimate that is achieved by the user doing the exercise without the selected exercise intensity being applied; and a third graphic indicator corresponding to an additional exercise amount achievement estimate that is achieved by the user doing the exercise with the selected exercise intensity being applied.

17. An operation method of an electronic device, the method comprising:

providing a personalized target exercise amount for a user wearing a wearable device;

receiving a user input that selects an exercise intensity to be applied to an exercise to be performed by the user;

transmitting, to the wearable device, setting data on the exercise intensity selected by the user input;

receiving, from the wearable device, sensor data comprising movement information obtained during the exercise of the user wearing the wearable device;

estimating an exercise amount of the user based on the received sensor data and the selected exercise intensity; and outputting a graphical user interface (GUI) in which an exercise activity indicator comprising at least one graphic indicator for indicating the estimated exercise amount is displayed, wherein the at least one graphic indicator comprises:

a first graphic indicator corresponding to a target exercise amount to be achieved by the user through the exercise;

a second graphic indicator corresponding to an exercise amount achievement estimate that is achieved by the user doing the exercise without the selected exercise intensity being applied; and a third graphic indicator corresponding to an additional exercise amount achievement estimate that is achieved by the user doing the exercise with the selected exercise intensity being applied.

18. The operation method of claim 17, wherein the outputting of the GUI comprises:

outputting the GUI in which the first graphic indicator and the second graphic indicator are displayed as being overlaid, the first graphic indicator and the third graphic indicator are displayed as being overlaid, and the third graphic indicator is displayed as starting from an end point of the second graphic indicator.

19. A non-transitory computer-readable storage medium storing instructions that, when executed by a processor, cause the processor to perform the operation method of claim 17.

* * * * *